US006956017B1

(12) United States Patent
Catalan et al.

(10) Patent No.: US 6,956,017 B1
(45) **Date of Patent: *Oct. 18, 2005**

(54) LAUNDRY DETERGENT COMPOSITIONS WITH FABRIC CARE

(75) Inventors: Kemal Vatansever Catalan, Cincinnati, OH (US); Patrick Firmin August Delplancke, Laarne (BE); Axel Masschelein, Brussels (BE); Pramod Kakumanu Reddy, West Chester, OH (US); Diane Barbara Parry, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 298 days.

This patent is subject to a terminal disclaimer.

(21) Appl. No.: 10/111,495

(22) PCT Filed: Oct. 13, 2000

(86) PCT No.: PCT/US00/28438

§ 371 (c)(1),
(2), (4) Date: Oct. 3, 2002

(87) PCT Pub. No.: WO01/32816

PCT Pub. Date: May 10, 2001

(30) Foreign Application Priority Data

Oct. 13, 2000 (US) ..... PCT/US99/25393

(51) Int. Cl.[7] ..... C11D 1/72; C11D 1/83; C11D 3/30; C11D 3/26

(52) U.S. Cl. ..... 510/320; 510/321; 510/336; 510/337; 510/340; 510/350; 510/356; 510/357; 510/503

(58) Field of Search ..... 510/320, 321, 510/336, 337, 340, 350, 356, 357, 503, 505; 8/137

(56) References Cited

U.S. PATENT DOCUMENTS

| | | | | |
|---|---|---|---|---|
| 3,917,817 A | | 11/1975 | Vanlerberghe et al. | |
| 4,013,787 A | | 3/1977 | Varlerberghe et al. | |
| 4,299,817 A | * | 11/1981 | Hannan et al. | 424/70.13 |
| 4,371,517 A | | 2/1983 | Vanlerberghe et al. | |
| 4,844,821 A | * | 7/1989 | Mermelstein et al. | 510/328 |
| 6,228,828 B1 | * | 5/2001 | Panandiker et al. | 510/332 |
| 6,251,846 B1 | * | 6/2001 | Panandiker et al. | 510/332 |
| 6,482,787 B1 | * | 11/2002 | Panandiker et al. | 510/336 |

FOREIGN PATENT DOCUMENTS

| | | | |
|---|---|---|---|
| DE | 27 50 777 | | 5/1978 |
| WO | WO 98/12295 | | 3/1998 |
| WO | WO 99/14300 | | 3/1999 |
| WO | WO99/14301 | * | 3/1999 |

* cited by examiner

*Primary Examiner*—Gregory R. Del Cotto
(74) *Attorney, Agent, or Firm*—Armina E. Matthews; Julia A. Glazer; Kim William Zerby

(57) ABSTRACT

The present invention is directed to laundry detergent compositions comprising a semi-polar nonionic surfactant and a cyclic amine based polymer. Such compositions provide good cleaning performance together with excellent fabric care benefits.

12 Claims, No Drawings

LAUNDRY DETERGENT COMPOSITIONS WITH FABRIC CARE

TECHNICAL FIELD

The present invention relates to laundry detergent compositions comprising a semi-polar nonionic surfactant and certain cyclic amine based polymer, oligomer or copolymer materials.

BACKGROUND OF THE INVENTION

It is well known that alternating cycles of using and laundering fabrics and textiles, such as articles of worn clothing and apparel, will inevitably adversely affect the appearance and integrity of the fabric and textile items so used and laundered. Fabrics and textiles simply wear out over time and with use. Laundering of fabrics and textiles is necessary to remove soils and stains which accumulate therein and thereon during ordinary use. However, the laundering operation itself, over many cycles, can accentuate and contribute to the deterioration of the integrity and the appearance of such fabrics and textiles.

Deterioration of fabric integrity and appearance can manifest itself in several ways Short fibers are dislodged from woven and knit fabric/textile structures by the mechanical action of laundering. These dislodged fibers may form lint, fuzz or "pills" which are visible on the surface of fabrics and diminish the appearance of newness of the fabric. Further, repeated laundering of fabrics and textiles, especially with bleach-containing laundry products, can remove dye from fabrics and textiles and impart a faded, worn out appearance as a result of diminished color intensity, and in many cases, as a result of changes in hues or shades of color.

Given the foregoing, several materials which could be added to laundry detergent products that would associate themselves with the fibers of the fabrics and textiles laundered using such detergent products and thereby reduce or minimize the tendency of the laundered fabric/textiles to deteriorate in appearance, have been identified in the art. Examples of such materials are cationic softening surfactants, cyclic amine based polymers, dye transfer inhibitors, chelating agents, crystal growth inhibitors.

However, it has been found that the fabric care cationic cyclic amine based polymers are not highly compatible with the high levels of anionic surfactants usually formulated within the conventional laundry detergent compositions. It has been found further that those anionic surfactants significantly decrease the efficiency of such cyclic amine based compounds. Such high levels of anionic surfactants are generally used to provide good cleaning properties. Therefore, in order to formulate compositions with such cationic cyclic amine based polymers, detergent compositions have been formulated without anionic surfactants but with nonionic surfactants. However, it has been found that detergent compositions with a high level of nonionic surfactants do not provide the same cleaning performance as comparable high level of anionic surfactants and are more difficult to formulate, especially at high electrolyte content.

In view of the above, the object of the present invention is therefore to formulate a laundry detergent composition which provide excellent cleaning properties together with excellent fabric care benefits. It has been surprisingly found that the combination of a semi-polar nonionic surfactant with the above mentioned cationic cyclic amine based polymer provide both excellent cleaning properties together with excellent fabric care benefits.

It has been further found that the combination of the semi-polar nonionic surfactants with the cyclic amine based polymers, of the present invention provide good dye transfer inhibition and antifading.

Furthermore, it has been found that that the compositions of the present invention demonstrate high physical stability when formulated in a liquid form.

SUMMARY OF THE INVENTION

The present invention is directed to laundry detergent compositions comprising a semi-polar nonionic surfactant and a cyclic amine based polymer, oligomer or copolymer. Such compositions provide good cleaning performance as well as the desired fabric appearance and integrity benefits. The cyclic amine based polymer, oligomer or copolymer is characterized by the following formula as defined below.

$$T\text{—}[W\text{—}R_2]_x\text{—}W\text{—}T \quad A_b$$

In its method aspect, the present invention relates to the laundering of fabrics and textiles in aqueous washing or treating solutions formed from effective amounts of the detergent compositions described herein, or formed from the individual components of such compositions. Laundering of fabrics and textiles in such washing solutions, followed by rinsing and drying, imparts fabric cleaning as well as fabric appearance benefits to the fabric and textile articles so treated. Such fabric care benefits can include improved overall appearance, pill/fuzz reduction, antifading, improved dye transfer inhibition, improved abrasion resistance, and/or enhanced softness.

DETAILED DESCRIPTION OF THE INVENTION

The laundry detergent compositions of the present invention comprise a cyclic amine based polymer and an amine oxide surfactants and provide excellent cleaning properties together with excellent fabric care benefits.

Without wishing to be bound by theory, it is believed that the semi-polar nonionic surfactants by their chemical nature, introduce some 'hidden' anionic character. Therefore, those semi-polar nonionic surfactants so provide good cleaning properties while not interacting with the cationic polymers, thereby providing excellent fabric cleaning and fabric care properties.

In addition, it has also been surprisingly found that such semi-polar nonionic surfactants act as hydrotropes within compositions of the present invention, when formulated in the liquid form. Indeed, without wishing to be bound by theory, it is known in the art that high levels of nonionic surfactants within liquid compositions lead to phase separation. It has been found that the semi-polar nonionic surfactants of the present invention, act as hydrotropes and reduce greatly phase separation. These semi-polar nonionic surfactants therefore are found to facilitate the formulation of high nonionic detergent compositions and to increase the physical stability of liquid products. This allows to formulate laundry detergent compositions comprising a high level of nonionic surfactants, which are perfectly fluid isotropic liquids.

The first essential element of the laundry detergent compositions of the present invention is the cyclic amine based polymer, oligomer or copolymer as described hereinafter:

A) Cyclic Amine Based Polymer, Oligomer or Copolymer Materials

The first essential component of the compositions of the present invention is one or more cyclic amine based polymer, oligomer or copolymer. Such materials have been found to impart a number of appearance benefits to fabrics and textiles laundered in aqueous washing solutions formed from detergent compositions which contain such cyclic amine based fabric treatment materials. Such fabric appearance benefits can include, for example, improved overall appearance of the laundered fabrics, reduction of the formation of pills and fuzz, improved dye transfer inhibition, protection against color fading, improved abrasion resistance, etc.

As mentioned above, the combination of semi-polar nonionic surfactants with the cyclic amine based fabric treatment materials used in the compositions and methods according to the present invention can provide such fabric appearance benefits while maintaining good cleaning performance.

The cyclic amine based polymer, oligomer or copolymer component of the compositions herein may comprise combinations of these cyclic amine based materials. For example, a mixture of piperadine and epihalohydrin condensates can be combined with a mixture of morpholine and epihalohydrin condensates to achieve the desired fabric treatment results. Moreover, the molecular weight of cyclic amine based fabric treatment materials can vary within the mixture as is illustrated in the Examples below.

As will be apparent to those skilled in the art, an oligomer is a molecule consisting of only a few monomer units while polymers comprise considerably more monomer units. For the present invention, oligomers are defined as molecules having an average molecular weight below about 1,000 and polymers are molecules having an average molecular weight of greater than about 1,000. Copolymers are polymers or oligomers wherein two or more dissimilar monomers have been simultaneously or sequentially polymerized. Copolymers of the present invention can include, for example, polymers or oligomers polymerized from a mixture of a primary cyclic amine based monomer, e.g., piperadine, and a secondary cyclic amine monomer, e.g., morpholine.

The cyclic amine based fabric treatment component of the detergent compositions herein will generally be comprised at a level of from 0.01% to 5% by the weight of the detergent composition, preferably at a level of from 0.1% to 4% by weight, more preferably at a level of from 0.75% to 3%.

The cyclic amine based polymers, oligomers or copolymers suitable for the purpose of the present invention are characterized by the following general formula:

$$T\text{—}[W\text{—}R_2]_x\text{—}W\text{—}T \quad A_b$$

wherein;

each T is independently selected from the group consisting of H, $C_1$–$C_{12}$ alkyl, substituted alkyl, $C_7$–$C_{12}$ alkylaryl, —$(CH_2)_hCOOM$, —$(CH_2)_hSO_3M$, $CH_2CH(OH)SO_3M$, —$(CH_2)_hOSO_3M$,

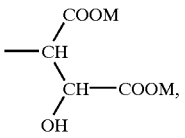

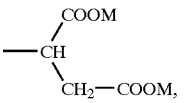

-continued

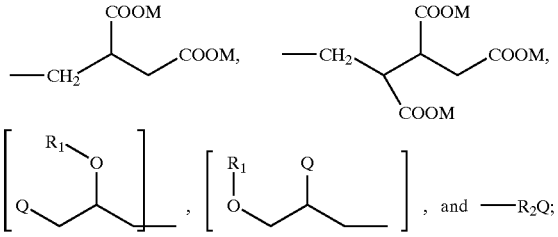

wherein W comprises at least one cyclic constituent selected from the group consisting of:

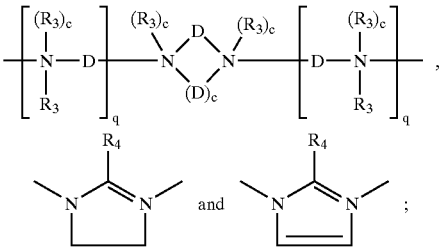

in addition to the at least one cyclic constituent, W may also comprise an aliphatic or substituted aliphatic moiety of the general structure;

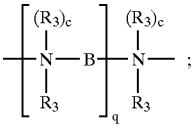

each B is independently $C_1$–$C_{12}$ alkylene, $C_1$–$C_{12}$ substituted alkylene, $C_3$–$C_{12}$ alkenylene, $C_8$–$C_{12}$ dialkylarylene, $C_8$–$C_{12}$ dialkylarylenediyl, and —$(R_5O)_nR_5$—;

each D is independently $C_2$–$C_6$ alkylene;

each Q is independently selected from the group consisting of hydroxy, $C_1$–$C_{18}$ alkoxy, $C_2$–$C_{18}$ hydroxyalkoxy, amino, $C_1$–$C_{18}$ alkylamino, dialkylamino, trialkylamino groups, heterocyclic monoamino groups and diamino groups;

each $R_1$ is independently selected from the group consisting of H, $C_1$–$C_8$ alkyl and $C_1$–$C_8$ hydroxyalkyl;

each $R_2$ is independently selected from the group consisting of $C_1$–$C_{12}$ alkylene, $C_1$–$C_{12}$ alkenylene, —$CH_2$—$CH(OR_1)$—$CH_2$, $C_8$–$C_{12}$ alkarylene, $C_4$–$C_{12}$ dihydroxyalkylene, poly($C_2$–$C_4$ alkyleneoxy)alkylene, $H_2CH(OH)CH_2OR_2OCH_2CH(OH)CH_2$—, and $C_3$–$C_{12}$ hydrocarbyl moieties;

provided that when $R_2$ is a $C_3$–$C_{12}$ hydrocarbyl moiety the hydrocarbyl moiety can comprise from about 2 to about 4 branching moieties of the general structure:

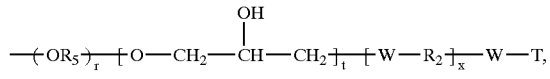

each $R_3$ is independently selected from the group consisting of H, $R_2$, O, $C_1$–$C_{20}$ hydroxyalkyl, $C_1$–$C_{20}$ alkyl, substituted alkyl, $C_6$–$C_{11}$ aryl, substituted aryl, $C_7$–$C_{11}$ alkylaryl, $C_1$–$C_{20}$ aminoalkyl, —$(CH_2)_h$COOM, —$(CH_2)_h$$SO_3$M, $CH_2$CH(OH)$SO_3$M, —$(CH_2)_h$OSO3M,

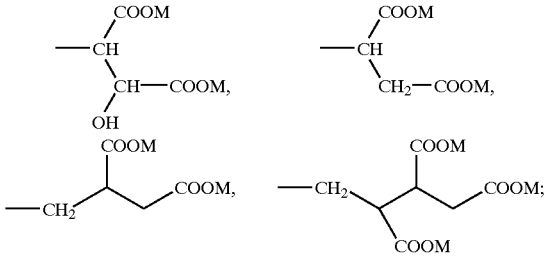

Amongst suitable cyclic amine based compounds of the present invention are those compounds wherein at least about 10 mole %, preferably at least about 20 mole %, more preferably at least about 30 mole %, and most preferably at least about 50 mole % of the $R_3$ groups are O, provided that O is only present on a tertiary N.

Amongst further suitable cyclic amine based compounds of the present invention are those compounds wherein:

at least about 1.0%, preferably at least abut 5.0%, and more preferably at least about 10%, and most preferably at least about 20% of the total number of T and $R_3$ groups are anionic moieties selected from the group consisting of —$(CH_2)_h$COOM, —$(CH_2)_h$$SO_3$M, $CH_2$CH(OH)$SO_3$M, —$(CH_2)_h$$OSO_3$M,

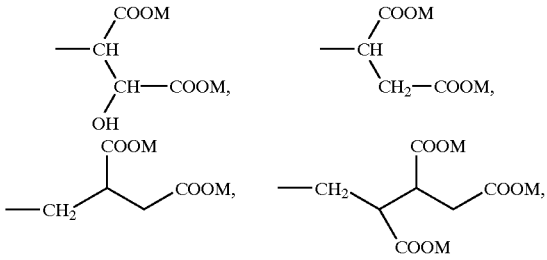

and mixtures thereof.

each $R_4$ is independently selected from the group consisting of H, $C_1$–$C_{22}$ alkyl, $C_1$–$C_{22}$ hydroxyalkyl, aryl and $C_7$–$C_{22}$ alkylaryl;

each $R_5$ is independently selected from the group consisting of $C_2$–$C_8$ alkylene, $C_2$–$C_8$ alkyl substituted alkylene; and A is a compatible monovalent or di or polyvalent anion;

M is a compatible cation;

b=number necessary to balance the charge;

each x is independently from 3 to about 1000, preferably from 3 to 25, more preferably from 4 to 20;

each c is independently 0 or 1;

each h is independently from about 1 to about 8;

each q is independently from 0 to about 6;

each n is independently from 1 to about 20;

each r is independently from 0 to about 20; and each t is independently from 0 to 1.

These cyclic amine based polymers can be linear or branched. One specific type of branching can be introduced using a polyfunctional crosslinking agent. An example of such polymer is exemplified below.

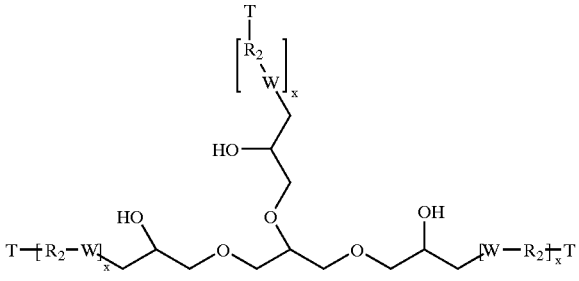

The Example section below contains numerous non-limiting examples of cyclic amine polymers according to the present invention.

1) a cyclic amine such as imidazole, alkyl imidazole, aminoalkyl imidazole, benzimidazole, piperazine, aminoalkyl piperazine, bis(N-aminoalkyl)piperazine, aminoalkyl morpholine, aminoalkyl piperidine, and optionally an acyclic amine and mixtures thereof;

2) a cross linking agent selected from the group consisting of 1,2 dichloroethane, 1,2 dichloropropane, 1,3 dichloropropane, 1,3 dichloropronae-2-ol, 1,4 dichlorobutane, 1,6 dichlorohexane, epichlorohydrin, bisepoxybutane, bisglicedyl ether of 4,4'didihydroxydiphenyl-dimethylmethane, bishalohydrins of C2–C8 diols, bisglycidyl ethers C2–C18 diols, bisglycidyl ethers of polyalkyleneglycols and mixtures thereof Preferred cyclic amine based compounds that fall within the above general structure include compounds:

wherein each $R_1$ is H; and at least one W is selected from the group consisting of:

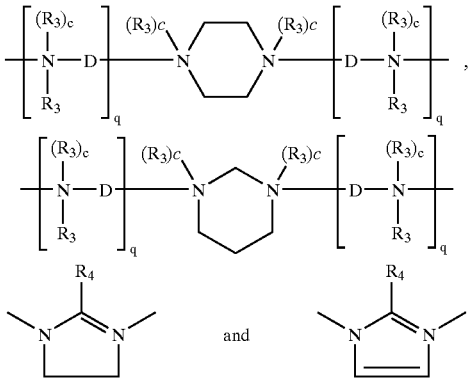

Even more preferred compounds for the fabric appearance and integrity benefits are those:

wherein each $R_1$ is H; and at least one W is selected from the group consisting of:

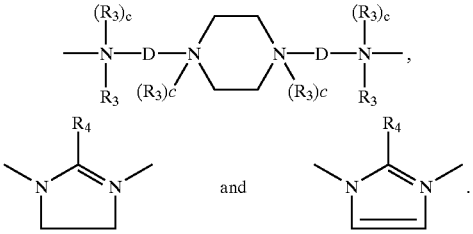

And most preferred compounds for the fabric appearance and integrity benefits are those:

wherein each $R_1$ is H; and at least one W is selected from the group consisting of:

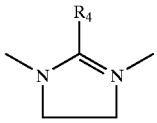

and

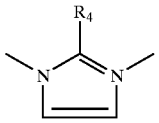

Preferred compounds to be used as the linking group $R_2$ include, but are not limited to: polyepoxides, ethylenecarbonate, propylenecarbonate, urea, α, β-unsaturated carboxylic acids, esters of α, β-unsaturated carboxylic acids, amides of α, β-unsaturated carboxylic acids, anhydrides of α, β-unsaturated carboxylic acids, di- or polycarboxylic acids, esters of di- or polycarboxylic acids, amides of di- or polycarboxylic acids, anhydrides of di- or polycarboxylic acids, glycidylhalogens, chloroformic esters, chloroacetic esters, derivatives of chloroformic esters, derivatives of chloroacetic esters, epihalohydrins, glycerol dichlorohydrins, bis-(halohydrins), polyetherdihalo-compounds, phosgene, polyhalogens, functionalized glycidyl ethers and mixtures thereof.

Moreover, $R_2$ can also comprise a reaction product formed by reacting one or more of polyetherdiamines, alkylenediamines, polyalkylenepolyamines, alcohols, alkyleneglycols and polyalkyleneglycols with α, β-unsaturated carboxylic acids, esters of α, β-unsaturated carboxylic acids, amides of α, β-unsaturated carboxylic acids and anhydrides of α, β-unsaturated carboxylic acids provided that the reaction products contain at least two double bonds, two carboxylic groups, two amide groups or two ester groups.

Additionally preferred cyclic amine based polymer, oligomer or copolymer materials for use herein include adducts of two or more compositions selected from the group consisting of piperazine, piperadine, imidazole, epichlorohydrin benzyl quat, epichlorohydrin methyl quat, morpholine and mixtures thereof.

B) The Semi-polar Nonionic Surfactant

The second essential element of the laundry detergent compositions of the present invention is a semi-polar nonionic surfactant, preferably an amine oxide surfactant.

Semi-polar nonionic surfactants are a special category of nonionic surfactants which include water-soluble amine oxides containing one alkyl moiety of from about 8 to about 18 carbon atoms and 2 moieties selected from the group consisting of alkyl groups and hydroxyalkyl groups containing from about 1 to 5 about 3 carbon atoms; water-soluble phosphine oxides containing one alkyl moiety of from about 8 to about 18 carbon atoms and 2 moieties selected from the group consisting of alkyl groups and hydroxyalkyl groups containing from about 1 to about 3 carbon atoms; and water-soluble sulfoxides containing one alkyl moiety of from about 8 to about 18 carbon atoms and a moiety selected from the group consisting of alkyl and hydroxyalkyl moieties of from about 1 to about 3 carbon atoms.

Preferred semi-polar nonionic detergent surfactants for the purpose of the present invention are the amine oxide surfactants having the formula:

$$R^3(OR^4)_xN^{\rightarrow O}(R^5)_2$$

wherein $R^3$ is an alkyl, hydroxyalkyl, or alkyl phenyl group or mixtures thereof containing from about 8 to about 22 carbon atoms; $R^4$ is an alkylene or hydroxyalkylene group containing from about 2 to about 3 carbon atoms or mixtures thereof; x is from 0 to about 3; and each $R^5$ is an alkyl or hydroxyalkyl group containing from about 1 to about 3 carbon atoms or a polyethylene oxide group containing from about 1 to about 3 ethylene oxide groups. The $R^5$ groups can be attached to each other, e.g., through an oxygen or nitrogen atom, to form a ring structure.

These amine oxide surfactants in particular include $C_{10}$–$C_{18}$ alkyl dimethyl amine oxides and $C_8$–$C_{12}$ alkoxy ethyl dihydroxy ethyl amine oxides, more preferably the $C_{12}$–$C_{14}$ alkyl dimethyl amine oxide.

The laundry detergent compositions of the present invention typically comprise from 0.1% to 20%, preferably from about 1% to about 10%, more preferably from 2% to 7% by weight of such semi-polar nonionic surfactants.

Detergent Components

The laundry detergent compositions of the present invention may contain additional detergent components. The precise nature of these additional component, and levels of incorporation thereof will depend on the physical form of the composition, and the nature of the cleaning operation for which it is to be used.

The laundry detergent compositions of the present invention preferably further comprise a detergent ingredient selected from nonionic and/or cationic surfactants, a cellulosic based polymers or oligomers, dye transfer inhibiting polymers, a mannanase enzyme and/or mixtures thereof.

When formulated as compositions suitable for use in a laundry machine washing method, the compositions of the invention preferably contain both a surfactant and a builder compound and additionally one or more detergent components preferably selected from organic polymeric compounds, bleaching agents, additional enzymes, suds suppressors, dispersants, lime-soap dispersants, soil suspension and anti-redeposition agents and corrosion inhibitors. Laundry compositions can also contain softening agents, as additional detergent components.

The compositions of the invention can also be used as detergent additive products. Such additive products are intended to supplement or boost the performance of conventional detergent compositions.

The laundry detergent compositions according to the invention can be liquid, paste, gels, bars, tablets, spray, foam, powder or granular. Granular compositions can also be in "compact" form and the liquid compositions can also be in a "concentrated" form.

If needed the density of the laundry detergent compositions herein ranges from 400 to 1200 g/liter, preferably 500 to 950 g/liter of composition measured at 20° C.

The "compact" form of the compositions herein is best reflected by density and, in terms of composition, by the amount of inorganic filler salt; inorganic filler salts are conventional ingredients of detergent compositions in powder form; in conventional detergent compositions, the filler salts are present in substantial amounts, typically 17–35% by weight of the total composition. In the compact compositions, the filler salt is present in amounts not exceeding 15% of the total composition, preferably not exceeding 10%, most preferably not exceeding 5% by weight of the composition. The inorganic filler salts, such as meant in the present compositions are selected from the alkali and alkaline-earth-metal salts of sulphates and chlorides. A preferred filler salt is sodium sulphate.

Liquid detergent compositions according to the present invention can also be in a "concentrated form", in such case, the liquid detergent compositions according the present invention will contain a lower amount of water, compared to conventional liquid detergents. Typically the water content of the concentrated liquid detergent is preferably less than 40%, more preferably less than 30%, most preferably less than 20% by weight of the detergent composition.

Suitable detergent compounds for use herein are selected from the group consisting of the below described compounds.

Surfactants

The laundry detergent compositions of the present invention can further comprise other detersive surfactants selected from anionic, nonionic, zwitterionic, ampholytic or cationic type or can comprise compatible mixtures of these types.

Preferably the laundry detergent compositions of the present invention will comprise a high level of nonionic surfactants—one or more—and a low level of anionic surfactants—one or more. More preferably the nonionic surfactants will be comprised within the laundry detergent composition of the present invention at a level of from 1%–50%, most preferably at a level of from 5%–30%, even most preferably at a level of from 15%–25% by weight of the total composition. More preferably the anionic surfactants will be comprised within the laundry detergent compositions of the present invention at a level of from 0%–10%, most preferably at a level of from 0%–5%. Even most preferably, the laundry detergent compositions of the present invention will comprise no anionic surfactants.

Preferred nonionic surfactants for the laundry detergent compositions of the present invention are the condensation products of primary and secondary aliphatic alcohols with from about 1 to about 25 moles of ethylene oxide, and/mixtures thereof. The alkyl chain of the aliphatic alcohol can either be straight or branched, primary or secondary, and generally contains from about 8 to about 22 carbon atoms. Preferred are the condensation products of alcohols having an alkyl group containing from about 8 to about 20 carbon atoms, more preferably from about 10 to about 18 carbon atoms, with from about 2 to about 10 moles of ethylene oxide per mole of alcohol. About 3 to about 9 moles of ethylene oxide and most preferably from 5 to 7 moles of ethylene oxide per mole of alcohol are present in said condensation products. Examples of commercially available nonionic surfactants of this type include Tergitol™ 15-S-9 (the condensation product of $C_{11}$–$C_{15}$ linear alcohol with 9 moles ethylene oxide), Tergitol™ 24-L-6 NMW (the condensation product of $C_{12}$–$C_{14}$ primary alcohol with 6 moles ethylene oxide with a narrow molecular weight distribution), both marketed by Union Carbide Corporation; Neodol™ 45-9 (the condensation product of $C_{14}$–$C_{15}$ linear alcohol with 9 moles of ethylene oxide), Neodol™ 23-3 (the condensation product of $C_{12}$–$C_{13}$ linear alcohol with 3.0 moles of ethylene oxide), Neodol™ 45-7 (the condensation product of $C_{14}$–$C_{15}$ linear alcohol with 7 moles of ethylene oxide), Neodol™ 45-5 (the condensation product of $C_{14}$–$C_{15}$ linear alcohol with 5 moles of ethylene oxide) marketed by Shell Chemical Company, Kyro™ EOB (the condensation product of $C_{13}$–$C_{15}$ alcohol with 9 moles ethylene oxide), marketed by The Procter & Gamble Company, and Genapol LA O3O or O5O (the condensation product of $C_{12}$–$C_{14}$ alcohol with 3 or 5 moles of ethylene oxide) marketed by Hoechst. Preferred range of HLB in these products is from 8–11 and most preferred from 8–10.

Also useful as the nonionic surfactant of the present invention are the alkylpolysaccharides disclosed in U.S. Pat. No. 4,565,647, Llenado, issued Jan. 21, 1986, having a hydrophobic group containing from about 6 to about 30 carbon atoms, preferably from about 10 to about 16 carbon atoms and a polysaccharide, e.g. a polyglycoside, hydrophilic group containing from about 1.3 to about 10, preferably from about 1.3 to about 3, most preferably from about 1.3 to about 2.7 saccharide units. Any reducing saccharide containing 5 or 6 carbon atoms can be used, e.g., glucose, galactose and galactosyl moieties can be substituted for the glucosyl moieties (optionally the hydrophobic group is attached at the 2-, 3-, 4-, etc. positions thus giving a glucose or galactose as opposed to a glucoside or galactoside). The intersaccharide bonds can be, e.g., between the one position of the additional saccharide units and the 2-, 3-, 4-, and/or 6-positions on the preceding saccharide units.

The preferred alkylpolyglycosides have the formula:

$$R^2O(C_nH_{2n}O)_t(\text{glycosyl})_x$$

wherein $R^2$ is selected from the group consisting of alkyl, alkylphenyl, hydroxyalkyl, hydroxyalkylphenyl, and mixtures thereof in which the alkyl groups contain from about 10 to about 18, preferably from about 12 to about 14, carbon atoms; n is 2 or 3, preferably 2; t is from 0 to about 10, preferably 0; and x is from about 1.3 to about 10, preferably from about 1.3 to about 3, most preferably from about 1.3 to about 2.7. The glycosyl is preferably derived from glucose. To prepare these compounds, the alcohol or alkylpolyethoxy alcohol is formed first and then reacted with glucose, or a source of glucose, to form the glucoside (attachment at the 1-position). The additional glycosyl units can then be attached between their 1-position and the preceding glycosyl units 2-, 3-, 4- and/or 6-position, preferably predominately the 2-position.

Also useful as nonionic surfactants are the condensation products of ethylene oxide with a hydrophobic base formed by the condensation of propylene oxide with propylene glycol. The hydrophobic portion of these compounds will preferably have a molecular weight of from about 1500 to about 1800 and will exhibit water insolubility. The addition of polyoxyethylene moieties to this hydrophobic portion tends to increase the water solubility of the molecule as a whole, and the liquid character of the product is retained up to the point where the polyoxyethylene content is about 50% of the total weight of the condensation product, which corresponds to condensation with up to about 40 moles of ethylene oxide. Examples of compounds of this type include certain of the commercially-available Plurafac™ LF404 and Pluronic™ surfactants, marketed by BASF.

Also suitable for use as the nonionic surfactant are the condensation products of ethylene oxide with the product resulting from the reaction of propylene oxide and ethylenediamine. The hydrophobic moiety of these products consists of the reaction product of ethylenediamine and excess propylene oxide, and generally has a molecular weight of from about 2500 to about 3000. This hydrophobic moiety is condensed with ethylene oxide to the extent that the condensation product contains from about 40% to about 80% by weight of polyoxyethylene and has a molecular weight of from about 5,000 to about 11,000. Examples of this type of nonionic surfactant include certain of the commercially available Tetronic™ compounds, marketed by BASF.

Further useful nonionic surfactants are polyhydroxy fatty acid amide surfactants of the formula:

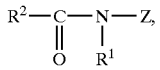

wherein $R^1$ is H, or $R^1$ is $C_{1-4}$ hydrocarbyl, 2-hydroxy ethyl, 2-hydroxy propyl or a mixture thereof, $R^2$ is $C_{5-31}$ hydrocarbyl, and Z is a polyhydroxyhydrocarbyl having a linear hydrocarbyl chain with at least 3 hydroxyls directly connected to the chain, or an alkoxylated derivative thereof. Preferably, $R^1$ is methyl, $R^2$ is a straight $C_{11-15}$ alkyl or $C_{16-18}$ alkyl or alkenyl chain such as coconut alkyl or mixtures thereof, and Z is derived from a reducing sugar such as glucose, fructose, maltose, lactose, in a reductive amination reaction.

Further nonionic surfactants are Polyethylene, polypropylene, and polybutylene oxide condensates of alkyl phenols, with the polyethylene oxide condensates being preferred. These compounds include the condensation products of alkyl phenols having an alkyl group containing from about 6 to about 14 carbon atoms, preferably from about 8 to about 14 carbon atoms, in either a straight-chain or branched-chain configuration with the alkylene oxide. In a preferred embodiment, the ethylene oxide is present in an amount equal to from about 2 to about 25 moles, more preferably from about 3 to about 15 moles, of ethylene oxide per mole of alkyl phenol. Commercially available nonionic surfactants of this type include Igepal™ CO-630, marketed by the GAF Corporation; and Triton™ X-45, X-114, X-100 and X-102, all marketed by the Rohm & Haas Company. These surfactants are commonly referred to as alkylphenol alkoxylates (e.g., alkyl phenol ethoxylates).

Cationic detersive surfactants suitable for use in the laundry detergent compositions of the present invention are those having one long-chain hydrocarbyl group. Examples of such cationic surfactants include the ammonium surfactants such as alkyltrimethylammonium halogenides, and those surfactants having the formula:

$$[R^2(OR^3)_y][R^4(OR^3)_y]^2R^5N^+X^-$$

wherein $R^2$ is an alkyl or alkyl benzyl group having from about 8 to about 18 carbon atoms in the alkyl chain, each $R^3$ is selected from the group consisting of $—CH_2CH_2—$, $—CH_2CH(CH_3)—$, $—CH_2CH(CH_2OH)—$, $—CH_2CH_2CH_2—$, and mixtures thereof; each $R^4$ is selected from the group consisting of $C_1$–$C_4$ alkyl, $C_1$–$C_4$ hydroxyalkyl, benzyl ring structures formed by joining the two $R^4$ groups, $—CH_2CHOH—CHOHCOR^6CHOHCH_2OH$ wherein $R^6$ is any hexose or hexose polymer having a molecular weight less than about 1000, and hydrogen when y is not 0; $R^5$ is the same as $R^4$ or is an alkyl chain wherein the total number of carbon atoms of $R^2$ plus $R^5$ is not more than about 18; each y is from 0 to about 10 and the sum of the y values is from 0 to about 15; and X is any compatible anion.

Quatemary ammonium surfactant suitable for the present invention has the formula (I):

Formula I

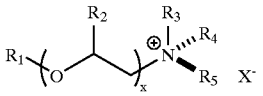

whereby R1 is a short chainlength alkyl (C6–C10) or alkylamidoalkyl of the formula (II):

Formula II

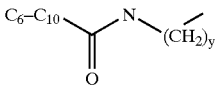

y is 24, preferably 3, whereby R2 is H or a C1–C3 alkyl, whereby x is 0–4, preferably 0–2, most preferably 0, whereby R3, R4 and R5 are either the same or different and can be either a short chain alkyl (C1–C3) or alkoxylated alkyl of the formula III, whereby $X^-$ is a counterion, preferably a halide, e.g. chloride or methylsulfate.

Formula III

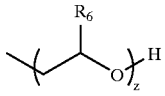

R6 is $C_1$–$C_4$ and z is 1 or 2.

Preferred quat ammonium surfactants are those as defined in formula I whereby $R_1$ is $C_8$, $C_{10}$ or mixtures thereof, x=o, $R_3$, $R_4$=$CH_3$ and $R_5$=$CH_2CH_2OH$.

Highly preferred cationic surfactants are the water-soluble quaternary ammonium compounds useful in the present composition having the formula:

$$R_1R_2R_3R_4N^+X^- \quad \text{(i)}$$

wherein $R_1$ is $C_8$–$C_{16}$ alkyl, each of $R_2$, $R_3$ and $R_4$ is independently $C_1$–$C_4$ alkyl, $C_1$–$C_4$ hydroxy alkyl, benzyl, and $—(C_2H_{40})_xH$ where x has a value from 2 to 5, and X is an anion. Not more than one of $R_2$, $R_3$ or $R_4$ should be benzyl.

The preferred alkyl chain length for $R_1$ is $C_{12}$–$C_{15}$ particularly where the alkyl group is a mixture of chain lengths derived from coconut or palm kernel fat or is derived synthetically by olefin build up or OXO alcohols synthesis. Preferred groups for $R_2R_3$ and $R_4$ are methyl and hydroxyethyl groups and the anion X may be selected from halide, methosulphate, acetate and phosphate ions.

Examples of suitable quatemary ammonium compounds of formulae (i) for use herein are:

coconut trimethyl ammonium chloride or bromide;

coconut methyl dihydroxyethyl ammonium chloride or bromide;

decyl triethyl ammonium chloride;

decyl dimethyl hydroxyethyl ammonium chloride or bromide;

$C_{12-15}$ dimethyl hydroxyethyl ammonium chloride or bromide;

coconut dimethyl hydroxyethyl ammonium chloride or bromide;

myristyl trimethyl ammonium methyl sulphate;

lauryl dimethyl benzyl ammonium chloride or bromide; lauryl dimethyl (ethenoxy)$_4$ ammonium chloride or bromide; choline esters (compounds of formula (i) wherein $R_1$ is $CH_2—CH_2—O—C(=O)—C_{12-14}$alkyl and $R_2R_3R_4$ are methyl).

di-alkyl imidazolines [compounds of formula (i)].

Other cationic surfactants useful herein are also described in U.S. Pat. No. 4,228,044, Cambre, issued Oct. 14, 1980 and in European Patent Application EP 000,224.

Other cationic materials are the fabric softening components including the water-insoluble quatemary-ammonium fabric softening actives or their corresponding amine precursor, the most commonly used having been di-long alkyl chain ammonium chloride or methyl sulfate.

Preferred cationic softeners among these include the following:

1) ditallow dimethylammonium chloride (DTDMAC);
2) dihydrogenated tallow dimethylammonium chloride;
3) dihydrogenated tallow dimethylammonium methylsulfate;
4) distearyl dimethylammonium chloride;
5) dioleyl dimethylammonium chloride;
6) dipalmityl hydroxyethyl methylammonium chloride;
7) stearyl benzyl dimethylammonium chloride;
8) tallow trimethylammonium chloride;
9) hydrogenated tallow trimethylammonium chloride;
10) $C_{12-14}$ alkyl hydroxyethyl dimethylammonium chloride;
11) $C_{12-18}$ alkyl dihydroxyethyl methylammonium chloride;
12) di(stearoyloxyethyl) dimethylammonium chloride (DSOEDMAC);
13) di(tallow-oxy-ethyl) dimethylammonium chloride;
14) ditallow imidazolinium methylsulfate;
15) 1-(2-tallowylamidoethyl)-2-tallowyl imidazolinium methylsulfate.

Biodegradable quatemary ammonium compounds have been presented as alternatives to the traditionally used di-long alkyl chain ammonium chlorides and methyl sulfates. Such quatemary ammonium compounds contain long chain alk(en)yl groups interrupted by functional groups such as carboxy groups. Said materials and fabric softening compositions containing them are disclosed in numerous publications such as EP-A-0,040,562, and EP-A-0,239,910.

The quaternary ammonium compounds and amine precursors herein have the formula (I) or (II), below:

(I)

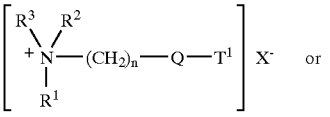

or (II)

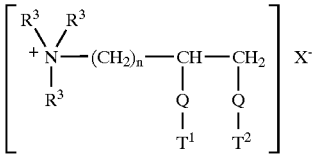

wherein Q is selected from —O—C(O)—, —C(O)—O—, —O—C(O)—O—, —$NR^4$—C(O)—, —C(O)—$NR^4$—;

$R^1$ is $(CH_2)_n$—Q-$T^2$ or $T^3$;

$R^2$ is $(CH_2)_m$—Q-$T^4$ or $T^5$ or $R^3$;

$R^3$ is $C_1$–$C_4$ alkyl or $C_1$–$C_4$ hydroxyalkyl or H;

$R^4$ is H or $C_1$–$C_4$ alkyl or $C_1$–$C_4$ hydroxyalkyl;

$T^1$, $T^2$, $T^3$, $T^4$, $T^5$ are independently $C_{11}$–$C_{22}$ alkyl or alkenyl;

n and m are integers from 1 to 4; and $X^-$ is a softener-compatible anion. Non-limiting examples of softener-compatible anions include chloride or methyl sulfate.

The alkyl, or alkenyl, chain $T^1$, $T^2$, $T^3$, $T^4$, $T^5$ must contain at least 11 carbon atoms, preferably at least 16 carbon atoms. The chain may be straight or branched. Tallow is a convenient and inexpensive source of long chain alkyl and alkenyl material. The compounds wherein $T^1$, $T^2$, $T^3$, $T^4$, $T^5$ represents the mixture of long chain materials typical for tallow are particularly preferred.

Specific examples of quatemary ammonium compounds suitable for use in the aqueous fabric softening compositions herein include:

N,N-di(tallowyl-oxy-ethyl)-N,N-dimethyl ammonium chloride;

N,N-di(canolyl-oxy-ethyl)-N,N-dimethyl ammonium chloride;

N,N-di(tallowyl-oxy-ethyl)-N-methyl, N-(2-hydroxyethyl) ammonium chloride;

N,N-di(canolyl-oxy-ethyl)-N-methyl, N-(2-hydroxyethyl) ammonium chloride;

N,N-di(2-tallowyloxy-2-oxo-ethyl)-N,N-dimethyl ammonium chloride;

N,N-di(2-canolyloxy-2-oxo-ethyl)-N,N-dimethyl ammonium chloride

N,N-di(2-tallowyloxyethylcarbonyloxyethyl)-N,N-dimethyl ammonium chloride;

N,N-di(2-canolyloxyethylcarbonyloxyethyl)-N,N-dimethyl ammonium chloride;

N-(2-tallowoyloxy-2-ethyl)-N-(2-tallowyloxy-2-oxo-ethyl)-N,N-dimethyl ammonium chloride;

N-(2-canolyloxy-2-ethyl)-N-(2-canolyloxy-2-oxo-ethyl)-N,N-dimethyl ammonium chloride;

N,N,N-tri(tallowyl-oxy-ethyl)-N-methyl ammonium chloride;

N,N,N-tricanolyl-oxy-ethyl)-N-methyl ammonium chloride;

N-(2-tallowyloxy-2-oxoethyl)-N-(tallowyl)-N,N-dimethyl ammonium chloride;

N-(2-canolyloxy-2-oxoethyl)-N-(canolyl)-N,N-dimethyl ammonium chloride;

1,2-ditallowyloxy-3-N,N,N-trimethylammoniopropane chloride; and 1,2-dicanolyloxy-3-N,N,N-trimethylammoniopropane chloride;

and mixtures of the above actives.

When included therein, the laundry detergent compositions of the present invention typically comprise from 0.2% to about 25%, preferably from about 1% to about 8% by weight of such cationic surfactants.

Conventional useful anionic surfactants can themselves be of several different types. For example, water-soluble salts of the higher fatty acids, i.e., "soaps", are useful anionic surfactants in the compositions herein. This includes alkali metal soaps such as the sodium, potassium, ammonium, and alkylolammonium salts of higher fatty acids containing from about 8 to about 24 carbon atoms, and preferably from about 12 to about 18 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap.

Additional non-soap anionic surfactants which are suitable for use herein include the water-soluble salts, preferably the alkali metal, and ammonium salts, of organic sulfuric reaction products having in their molecular structure an alkyl group containing from about 10 to about 20 carbon atoms and a sulfonic acid or sulfuric acid ester group. (Included in the term "alkyl" is the alkyl portion of acyl groups.) Examples of this group of synthetic surfactants are a) the sodium, potassium and ammonium alkyl sulfates, especially those obtained by sulfating the higher alcohols ($C_8$–$C_{18}$ carbon atoms) such as those produced by reducing the glycerides of tallow or coconut oil; b) the sodium, potassium and ammonium alkyl polyethoxylate sulfates, particularly those in which the alkyl group contains from 10 to 22, preferably from 12 to 18 carbon atoms, and wherein the polyethoxylate chain contains from 1 to 15, preferably 1 to 6 ethoxylate moieties; and c) the sodium and potassium alkylbenzene sulfonates in which the alkyl group contains from about 9 to about 15 carbon atoms, in straight chain or branched chain configuration, e.g., those of the type described in U.S. Pat. Nos. 2,220,099 and 2,477,383. Especially valuable are linear straight chain alkylbenzene sulfonates in which the average number of carbon atoms in the alkyl group is from about 11 to 13, abbreviated as $C_{11-13}$ LAS.

Further suitable surfactants for use in the laundry detergent compositions described herein are amine based surfactants of the general formula:

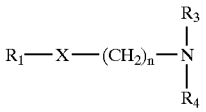

wherein $R_1$ is a $C_6$–$C_{12}$ alkyl group; n is from about 2 to about 4, X is a bridging group which is selected from NH, CONH, COO, or O or X can be absent; and $R_3$ and $R_4$ are individually selected from H, $C_1$–$C_4$ alkyl, or ($CH_2$—$CH_2$—$O(R_5)$) wherein $R_5$ is H or methyl. Especially preferred amines based surfactants include the following:

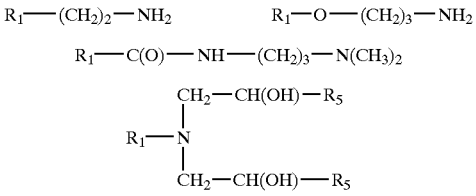

wherein $R_1$ is a $C_6$–$C_{12}$ alkyl group and $R_5$ is H or $CH_3$. Particularly preferred amines for use in the surfactants defined above include those selected from the group consisting of octyl amine, hexyl amine, decyl amine, dodecyl amine, $C_8$–$C_{12}$ bis(hydroxyethyl)amine, $C_8$–$C_{12}$ bis (hydroxyisopropyl)amine, $C_8$–$C_{12}$ amidopropyl dimethyl amine, or mixtures thereof. In a highly preferred embodiment, the amine based surfactant is described by the formula: $R_1$—C(O)—NH—$(CH_2)_3$—$N(CH_3)_2$ wherein $R_1$ is $C_8$–$C_{12}$ alkyl.

Cellulosic Based Polymer or Oligomer

The laundry detergent compositions of the present invention can further comprise one or more cellulosic based polymer or oligomer. Such materials have been found to impart a number of appearance benefits to fabrics and textiles laundered in aqueous washing solutions formed from detergent compositions which contain such cellulosic based fabric treatment materials. Such fabric appearance benefits can include, for example, improved overall appearance of the laundered fabrics, reduction of the formation of pills and fuzz, protection against color fading, improved abrasion resistance, etc.

One suitable type of cellulosic based polymer or oligomer fabric treatment material for use herein has an average molecular weight of from about 5,000 to about 2,000,000, preferably from about 50,000 to about 1,000,000.

These cellulosic based compounds will generally be comprised at a level of from 0.1% to 5%, more preferably at a level of from 0.5% to 4%, more preferably at a level of from 0.75% to 3% by the weight of the detergent composition.

One suitable group of cellulosic based polymer or oligomer materials for use herein is characterized by the following formula:

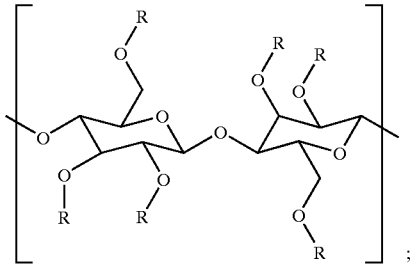

wherein each R is selected from the group consisting of $R_2$, $R_C$, and

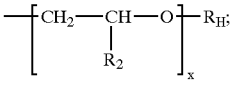

wherein:

each $R_2$ is independently selected from the group consisting of H and $C_1$–$C_4$ alkyl;

each $R_C$ is

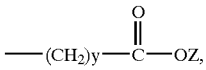

wherein each Z is independently selected from the group consisting of M, $R_2$, $R_C$, and $R_H$;

each $R_H$ is independently selected from the group consisting of $C_5$–$C_{20}$ alkyl, $C_5$–$C_7$ cycloalkyl, $C_7$–$C_{20}$ alkylaryl, $C_7$–$C_{20}$ arylalkyl, substituted alkyl, hydroxyalkyl, $C_1$–$C_{20}$ alkoxy-2-hydroxyalkyl, $C_7$–$C_{20}$ alkylaryloxy-2-hydroxyalkyl, $(R_4)_2$N-alkyl, $(R_4)_2$N-2-hydroxyalkyl, $(R_4)_3$N-alkyl, $(R_4)_3$N-2-hydroxyalkyl, $C_6$–$C_{12}$ aryloxy-2-hydroxyalkyl,

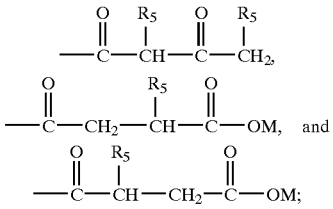

each $R_4$ is independently selected from the group consisting of H, $C_1$–$C_{20}$ alkyl, $C_5$–$C_7$ cycloalkyl, $C_7$–$C_{20}$ alkylaryl, $C_7$–$C_{20}$ arylalkyl, aminoalkyl, alkylaminoalkyl, dialkylaminoalkyl, piperidinoalkyl, morpholinoalkyl, cycloalkylaminoalkyl and hydroxyalkyl;

each $R_5$ is independently selected from the group consisting of H, $C_1$–$C_{20}$ alkyl, $C_5$–$C_7$ cycloalkyl, $C_7$–$C_{20}$ alkylaryl, $C_7$–$C_{20}$ arylalkyl, substituted alkyl, hydroxyalkyl, $(R_4)_2$N-alkyl, and $(R_4)_3$ N-alkyl;

wherein:

M is a suitable cation selected from the group consisting of Na, K, ½ Ca, and ½ Mg;

each x is from 0 to about 5;

each y is from about 1 to about 5; and provided that:

the Degree of Substitution for group $R_H$ is between about 0.001 and 0.1, more preferably between about 0.005 and 0.05, and most preferably between about 0.01 and 0.05;

the Degree of Substitution for group $R_C$ wherein Z is H or M is between about 0.2 and 2.0, more preferably between about 0.3 and 1.0, and most preferably between about 0.4 and 0.7;

if any $R_H$ bears a positive charge, it is balanced by a suitable anion; and two $R_4$'s on the same nitrogen can together form a ring structure selected from the group consisting of piperidine and morpholine.

The "Degree of Substitution" for group $R_H$, which is sometimes abbreviated herein "$DS_{RH}$", means the number of moles of group $R_H$ components that are substituted per anhydrous glucose unit, wherein an anhydrous glucose unit is a six membered ring as shown in the repeating unit of the general structure above.

The "Degree of Substitution" for group $R_C$, which is sometimes abbreviated herein "$DS_{RC}$", means the number of moles of group $R_C$ components, wherein Z is H or M, that are substituted per anhydrous glucose unit, wherein an anhydrous glucose unit is a six membered ring as shown in the repeating unit of the general structure above. The requirement that Z be H or M is necessary to insure that there are a sufficient number of carboxy methyl groups such that the resulting polymer is soluble. It is understood that in addition to the required number of $R_C$ components wherein Z is H or M, there can be, and most preferably are, additional $R_C$ components wherein Z is a group other than H or M.

Detergent Builder

The laundry detergent compositions herein may also further comprise from 0.1% to 80% by weight of a detergent builder. Preferably such compositions in liquid form will comprise from about 1% to 10% by weight of the builder component. Preferably such compositions in granular form will comprise from about 1% to 50% by weight of the builder component. Detergent builders are well known in the art and can comprise, for example, phosphate salts as well as various organic and inorganic nonphosphorus builders.

Water-soluble, nonphosphorus organic builders useful herein include the various alkali metal, ammonium and substituted ammonium polyacetates, carboxylates, polycarboxylates and polyhydroxy sulfonates. Examples of polyacetate and polycarboxylate builders are the sodium, potassium, lithium, ammonium and substituted ammonium salts of ethylene diamine tetraacetic acid, nitrilotriacetic acid, oxydisuccinic acid, mellitic acid, benzene polycarboxylic acids, and citric acid. Other suitable polycarboxylates for use herein are the polyacetal carboxylates described in U.S. Pat. No. 4,144,226, issued Mar. 13, 1979 to Crutchfield et al., and U.S. Pat. No. 4,246,495, issued Mar. 27, 1979 to Crutchfield et al., both of which are incorporated herein by reference. Particularly preferred polycarboxylate builders are the oxydisuccinates and the ether carboxylate builder compositions comprising a combination of tartrate monosuccinate and tartrate disuccinate described in U.S. Pat. No. 4,663,071, Bush et al., issued May 5, 1987, the disclosure of which is incorporated herein by reference.

Examples of suitable nonphosphorus, inorganic builders include the silicates, aluminosilicates, borates and carbonates. Particularly preferred are sodium and potassium carbonate, bicarbonate, sesquicarbonate, tetraborate decahydrate, and silicates having a weight ratio of $SiO_2$ to alkali metal oxide of from about 0.5 to about 4.0, preferably from about 1.0 to about 2.4. Also preferred are aluminosilicates including zeolites. Such materials and their use as detergent builders are more fully discussed in Corkill et al., U.S. Pat. No. 4,605,509, the disclosure of which is incorporated herein by reference. Also discussed in U.S. Pat. No. 4,605,509 are crystalline layered silicates which are suitable for use in the detergent compositions of this invention.

Optional Detergent Ingredients

The laundry detergent compositions of the present invention can also include any number of additional optional ingredients. These include conventional detergent composition components such as enzymes and enzyme stabilizing agents, suds boosters or suds suppressers, anti-tarnish and anticorrosion agents, bleaching agents, soil suspending agents, soil release agents, germicides, pH adjusting agents, non-builder alkalinity sources, chelating agents, organic and inorganic fillers, solvents, hydrotropes, optical brighteners, dye transfer inhibition agents, dyes and perfumes.

pH adjusting agents may be necessary in certain applications where the pH of the wash solution is greater than about 10.0 because the fabric integrity benefits of the defined compositions begin to diminish at a higher pH. Hence, if the wash solution is greater than about 10.0 after the addition of the cyclic amine based polymer, oligomer or copolymer materials of the present invention a pH adjuster should be used to reduce the pH of the washing solution to below about 10.0, preferably to a pH of below about 9.5 and most preferably below about 7.5. Suitable pH adjusters will be known to those skilled in the art.

A preferred optional ingredients for incorporation into the detergent compositions herein comprises a bleaching agent, e.g., a peroxygen bleach. Such peroxygen bleaching agents may be organic or inorganic in nature. Inorganic peroxygen bleaching agents are frequently utilized in combination with a bleach activator.

Useful organic peroxygen bleaching agents include percarboxylic acid bleaching agents and salts thereof. Suitable examples of this class of agents include magnesium monoperoxyphthalate hexahydrate, the magnesium salt of metachloro perbenzoic acid, 4-nonylamino-4-oxoperoxybutyric acid and diperoxydodecanedioic acid. Such bleaching agents are disclosed in U.S. Pat. No. 4,483,781, Hartman, Issued Nov. 20, 1984; European Patent Application EP-A-133,354, Banks et al., Published Feb. 20, 1985; and U.S. Pat. No. 4,412,934, Chung et al., Issued Nov. 1, 1983. Highly preferred bleaching agents also include 6-nonylamino-6-oxoperoxycaproic acid (NAPAA) as described in U.S. Pat. No. 4,634,551, Issued Jan. 6, 1987 to Bums et al.

Inorganic peroxygen bleaching agents may also be used, generally in particulate form, in the detergent compositions herein. Inorganic bleaching agents are in fact preferred. Such inorganic peroxygen compounds include alkali metal perborate and percarbonate materials. For example, sodium perborate (e.g. mono- or tetra-hydrate) can be used. Suitable inorganic bleaching agents can also include sodium or potassium carbonate peroxyhydrate and equivalent "percarbonate" bleaches, sodium pyrophosphate peroxyhydrate, urea peroxyhydrate, and sodium peroxide. Persulfate bleach (e.g., OXONE, manufactured commercially by DuPont) can also be used. Frequently inorganic peroxygen bleaches will be coated with silicate, borate, sulfate or water-soluble surfactants. For example, coated percarbonate particles are available from various commercial sources such as FMC, Solvay Interox, Tokai Denka and Degussa.

Inorganic peroxygen bleaching agents, e.g., the perborates, the percarbonates, etc., are preferably combined with bleach activators, which lead to the in situ production in aqueous solution (i.e., during use of the compositions herein for fabric laundering/bleaching) of the peroxy acid corresponding to the bleach activator. Various non-limiting examples of activators are disclosed in U.S. Pat. No. 4,915,854, Issued Apr. 10, 1990 to Mao et al.; and U.S. Pat. No. 4,412,934 Issued Nov. 1, 1983 to Chung et al. The nonanoyloxybenzene sulfonate (NOBS) and tetraacetyl ethylene diamine (TAED) activators are typical and preferred. Mixtures thereof can also be used. See also the hereinbefore referenced U.S. Pat. No. 4,634,551 for other typical bleaches and activators useful herein.

Other useful amido-derived bleach activators are those of the formulae:

$$R^1N(R^5)C(O)R^2C(O)L \text{ or } R^1C(O)N(R^5)R^2C(O)L$$

wherein $R^1$ is an alkyl group containing from about 6 to about 12 carbon atoms, $R^2$ is an alkylene containing from 1 to about 6 carbon atoms, $R^5$ is H or alkyl, aryl, or alkaryl containing from about 1 to about 10 carbon atoms, and L is any suitable leaving group. A leaving group is any group that is displaced from the bleach activator as a consequence of the nucleophilic attack on the bleach activator by the perhydrolysis anion. A preferred leaving group is phenol sulfonate.

Preferred examples of bleach activators of the above formulae include (6-5 octanamido-caproyl) oxybenzenesulfonate, (6-nonanamidocaproyl) oxybenzenesul-fonate, (6-decanamido-caproyl) oxybenzenesulfonate and mixtures thereof as described in the hereinbefore referenced U.S. Pat. No. 4,634,551.

Another class of useful bleach activators comprises the benzoxazin-type activators disclosed by Hodge et al. in U.S. Pat. No. 4,966,723, Issued Oct. 30, 1990, incorporated herein by reference. A highly preferred activator of the benzoxazin-type is:

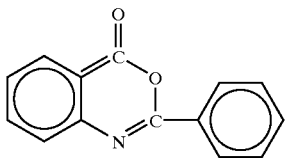

Still another class of useful bleach activators includes the acyl lactam activators, especially acyl caprolactams and acyl valerolactams of the formulae:

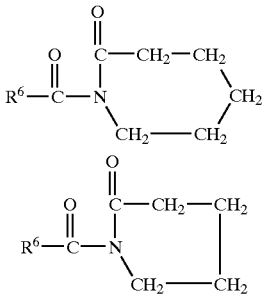

wherein $R^6$ is H or an alkyl, aryl, alkoxyaryl, or alkaryl group containing from 1 to about 12 carbon atoms. Highly preferred lactam activators include benzoyl caprolactam, octanoyl caprolactam, 3,5,5-trimethylhexanoyl caprolactam, nonanoyl caprolactam, decanoyl caprolactam, undecenoyl caprolactam, benzoyl valerolactam, octanoyl valerolactam, nonanoyl valerolactam, decanoyl valerolactam, undecenoyl valerolactam, 3,5,5-trimethylhexanoyl valerolactam and mixtures thereof. See also U.S. Pat. No. 4,545,784, Issued to Sanderson, Oct. 8, 1985, incorporated herein by reference, which disdoses acyl caprolactams, including benzoyl caprolactam, adsorbed into sodium perborate.

If utilized, peroxygen bleaching agent will generally comprise from about 2% to 30% by weight of the detergent compositions herein. More preferably, peroxygen bleaching agent will comprise from about 2% to 20% by weight of the compositions. Most preferably, peroxygen bleaching agent will be present to the extent of from about 3% to 15% by weight of the compositions herein. If utilized, bleach activators can comprise from about 2% to 10% by weight of the detergent compositions herein. Frequently, activators are employed such that the molar ratio of bleaching agent to activator ranges from about 1:1 to 10:1, more preferably from about 1.5:1 to 5:1.

Another highly preferred optional ingredient in the detergent compositions herein is a detersive enzyme component. Enzymes can be included in the present detergent compositions for a variety of purposes, including removal of protein-based, carbohydrate-based, or triglyceride-based stains from substrates, for the prevention of refugee dye transfer in fabric laundering, and for fabric restoration. Suitable enzymes include proteases, amylases, lipases, cellulases, peroxidases, mannanases, and mixtures thereof of any suitable origin, such as vegetable, animal, bacterial, fungal and yeast origin. Preferred selections are influenced by factors such as pH-activity and/or stability, optimal thermostability, and stability to active detergents, builders and the like. In this respect bacterial or fungal enzymes are preferred, such as bacterial amylases and proteases, and fungal cellulases.

"Detersive enzyme", as used herein, means any enzyme having a cleaning, stain removing or otherwise beneficial effect in a laundry detergent composition. Preferred enzymes for laundry purposes include, but are not limited to, proteases, cellulases, lipases, amylases and peroxidases.

Enzymes are normally incorporated into detergent, compositions at levels sufficient to provide a "cleaning-effective amount". The term "cleaning-effective amount" refers to any amount capable of producing a cleaning, stain removal, soil removal, whitening, deodorizing, or freshness improving effect on substrates such as fabrics. In practical terms for current commercial preparations, typical amounts are up to about 5 mg by weight, more typically 0.01 mg to 3 mg, of active enzyme per gram of the detergent composition. Stated otherwise, the compositions herein will typically comprise from 0.001% to 5%, preferably 0.01%–1% by weight of a commercial enzyme preparation. Protease enzymes are usually present in such commercial preparations at levels sufficient to provide from 0.005 to 0.1 Anson units (AU) of activity per gram of composition. Higher active levels may be desirable in highly concentrated detergent formulations.

Suitable examples of proteases are the subtilisins which are obtained from particular strains of *B. subtilis* and *B. licheniformis*. One suitable protease is obtained from a strain of *Bacillus,* having maximum activity throughout the pH range of 8–12, developed and sold as ESPERASE® by Novo Industries A/S of Denmark, hereinafter "Novo". The preparation of this enzyme and analogous enzymes is described in GB 1,243,784 to Novo. Other suitable proteases include ALCALASE® and SAVINASE® from Novo and MAXATASE® from International Bio-Synthetics, Inc., The Netherlands; as well as Protease A as disclosed in EP 130,756 A, Jan. 9, 1985 and Protease B as disclosed in EP 303,761 A, Apr. 28, 1987 and EP 130,756 A. Jan. 9, 1985. See also a high pH protease from *Bacillus* sp. NCIMB 40338 described in WO 9318140 A to Novo. Enzymatic detergents comprising protease, one or more other enzymes, and a reversible protease inhibitor are described in WO 9203529 A to Novo. Other preferred proteases include those of WO 9510591 A to Procter & Gamble. When desired, a protease having decreased adsorption and increased hydrolysis is available as described in WO 9507791 to Procter & Gamble. A recombinant trypsin-like protease for detergents suitable herein is described in WO 9425583 to Novo.

Cellulases usable herein include both bacterial and fungal types, preferably having a pH optimum between 5 and 10. U.S. Pat. No. 4,435,307, Barbesgoard et al., Mar. 6, 1984, discloses suitable fungal cellulases from *Humicola insolens* or *Humicola* strain DSM1800 or a cellulase 212-producing fungus belonging to the genus *Aeromonas,* and cellulase extracted from the hepatopancreas of a marine mollusk, *Dolabella Auricula Solander.* Suitable cellulases are also disclosed in GB-A-2.075.028; GB-A-2.095.275 and DE-OS-2.247.832. CAREZYME(® and CELLUZYME® (Novo) are especially useful. See also WO 9117243 to Novo.

Amylases (α and/or β) can be included for removal of carbohydrate-based stains. WO94/02597, Novo Nordisk A/S published Feb. 3, 1994, describes cleaning compositions which incorporate mutant amylases. See also WO95/10603, Novo Nordisk A/S, published Apr. 20, 1995. Other amylases known for use in cleaning compositions include both α- and β-amylases. α-Amylases are known in the art and include those disclosed in U.S. Pat. No. 5,003,257; EP 252,666; WO/91/00353; FR 2,676,456; EP 285,123; EP 525,610; EP 368,341; and British Patent specification no. 1,296,839 (Novo). Other suitable amylases are stability-enhanced amylases described in W094/18314, published Aug. 18, 1994 and WO96/05295, Genencor, published Feb. 22, 1996 and amylase variants having additional modification in the immediate parent available from Novo Nordisk A/S, disclosed in WO 95/10603, published April 95. Also suitable are amylases described in EP 277 216, WO95/26397 and WO96/23873 (all by Novo Nordisk). Examples of commercial α-amylases products are Purafect Ox Am® from Genencor and Termamyl®, Ban® , Fungamyl® and Duramyl®, all available from Novo Nordisk A/S Denmark. WO95/26397 describes other suitable amylases: a-amylases characterised by having a specific activity at least 25% higher than the specific activity of Termamyl® at a temperature range of 25° C. to 55° C. and at a pH value in the range of 8 to 10, measured by the Phadebas® α-amylase activity assay. Suitable are variants of the above enzymes, described in WO96/23873 (Novo Nordisk). Other amylolytic enzymes with improved properties with respect to the activity level and the combination of thermostability and a higher activity level are described in WO95135382.

Suitable lipase enzymes for detergent usage include those produced by microorganisms of the Pseudomonas group, such as *Pseudomonas stutzeri* ATCC 19.154, as disclosed in GB 1,372,034. See also, the lipase in Japanese Patent Application 53,20487, laid open Feb. 24, 1978. This lipase is available from Amano Pharmaceutical Co. Ltd., Nagoya, Japan, under the trade name Lipase P "Amano," or "Amano-P." Other suitable commercial lipases include Amano-CES, lipases ex *Chromobacter viscosum,* e.g. *Chromobacter viscosum* var. *lipolyticum* NRRLB 3673 from Toyo Jozo Co., Tagata, Japan; *Chromobacter viscosum* lipases from U.S. Biochemical Corp., U.S.A. and Disoynth Co., The Netherlands, and lipases ex *Pseudomonas gladioli.* LIPOLASE® enzyme derived from *Humicola lanuginosa* and commercially available from Novo, see also EP 341,947, is a preferred lipase for use herein.

Preferred enzyme for the compositions of the present invention is a mannanase enzyme. Encompassed are the following three mannans-degrading enzymes: EC 3.2.1.25: β-mannosidase, EC 3.2.1.78: Endo-1,4-β-mannosidase, referred therein after as "mannanase" and EC 3.2.1.100: 1,4-β-mannobiosidase (IUPAC Classification-Enzyme nomenclature, 1992 ISBN 0-12-227165-3 Academic Press). Preferably, the detergent compositions of the present invention comprise a β-1,4-Mannosidase (E.C. 3.2.1.78) referred to as "Mannanase". Indeed, it has been found that the compositions of the present invention comprising further a mannanase enzyme, provide excellent color care while maintaining superior cleaning performance.

Preferably, the mannanase enzyme will be an alkaline mannanase as defined below, more preferably, a mannanase originating from a bacterial source. Especially, the compositions of the present invention will comprise an alkaline mannanase selected from the mannanase from the strain *Bacillus agaradhaerens* NICMB 40482; the mannanase from *Bacillus subtilis* strain 168, gene yght; the mannanase from *Bacillus* sp. J633; the mannanase from *Bacillus* sp. AAI12 and/or the mannanase from the strain *Bacillus halodurans.* Most preferred mannanase for the inclusion in the detergent compositions of the present invention is the mannanase enzyme originating from *Bacillus* sp. 1633 as described in WO 99/64619. The terms "alkaline mannanase enzyme" is meant to encompass an enzyme having an enzymatic activity of at least 10%, preferably at least 25%, more preferably at least 40% of its maximum activity at a given pH ranging from 7 to 12, preferably 7.5 to 10.5.

A first more preferred mannanase for use in the present invention is the alkaline mannanase from *Bacillus agaradhaerens* NICMB 40482 which is described in WO 99/64619. More specifically, this mannanase is:

i) a polypeptide produced by *Bacillus agaradhaerens,* NCIMB 40482; or ii) a polypeptide comprising an amino acid sequence as shown in positions 32–344 of SEQ ID NO:6 as shown in WO 99/64619; or iii) an analogue of the polypeptide defined in i) or ii) which is at least 70% homologous with said polypeptide, or is derived from said polypeptide by substitution, deletion or addition of one or several amino acids, or is immunologically reactive with a polyclonal antibody raised against said polypeptide in purified form.

Also encompassed is the corresponding isolated polypeptide having mannanase activity selected from the group consisting of (a) polynucleotide molecules encoding a polypeptide having mannanase activity and comprising a sequence of nucleotides as shown in SEQ ID NO: 5 from nucleotide 94 to nucleotide 1032 as shown in WO 99/64619;

(b) species homologs of (a);

(c) polynucleotide molecules that encode a polypeptide having mannanase activity that is at least 70% identical to the amino acid sequence of SEQ ID NO: 6 from amino acid residue 32 to amino acid residue 344 as shown in WO 99/64619;

(d) molecules complementary to (a), (b) or (c); and (e) degenerate nucleotide sequences of (a), (b), (c) or (d).

The plasmid pSJ1678 comprising the polynucleotide molecule (the DNA sequence) encoding said mannanase has been transformed into a strain of the *Escherichia coli* which was deposited by the inventors according to the Budapest Treaty on the International Recognition of the Deposit of Microorganisms for the Purposes of Patent Procedure at the Deutsche Sammlung von Mikroorganismen und Zellkulturen GmbH, Mascheroder Weg 1b, D-38124 Braunschweig, Federal Republic of Germany, on 18 May 1998 under the deposition number DSM 12180.

A second more preferred enzyme is the mannanase from the *Bacillus subtilis* strain 168, which is described in U.S. Pat. No. 6,060,299. More specifically, this mannanase is:

i) is encoded by the coding part of the DNA sequence shown in SEQ ID No. 5 shown in the U.S. Pat. No. 6,060,299 or an analogue of said sequence; and/or ii) a polypeptide comprising an amino acid sequence as shown SEQ ID NO:6 shown in the U.S. Pat. No. 6,060,299; or iii) an analogue of the polypeptide defined in ii) which is at least 70% homologous with said polypeptide, or is derived from said polypeptide by substitution, deletion or addition of one or several amino acids, or is immunologically reactive with a polyclonal antibody raised against said polypeptide in purified form.

Also encompassed in the corresponding isolated polypeptide having mannanase activity selected from the group consisting of:

(a) polynucleotide molecules encoding a polypeptide having mannanase activity and comprising a sequence of nucleotides as shown in SEQ ID NO:5 as shown in the U.S. Pat. No. 6,060,299

(b) species homologs of (a);

(c) polynucleotide molecules that encode a polypeptide having mannanase activity that is at least 70% identical to the amino acid sequence of SEQ ID NO: 6 as shown in U.S. Pat. No. 6,060,299;

(d) molecules complementary to (a), (b) or (c); and (e) degenerate nucleotide sequences of (a), (b), (c) or (d).

A third more preferred mannanase is described in WO 99164619. More specifically, this mannanase is:

i) a polypeptide produced by *Bacillus* sp. I633;

ii) a polypeptide comprising an amino acid sequence as shown in positions 31–330 of SEQ ID NO:2 as shown in WO 99/64619; or iii) an analogue of the polypeptide defined in i) or ii) which is at least 65% homologous with said polypeptide, is derived from said polypeptide by substitution, deletion or addition of one or several amino acids, or is immunologically reactive with a polyclonal antibody raised against said polypeptide in purified form.

Also encompassed is the corresponding isolated polynucleotide molecule selected from the group consisting of:

(a) polynucleotide molecules encoding a polypeptide having mannanase activity and comprising a sequence of nucleotides as shown in SEQ ID NO: 1 from nucleotide 94 to nucleotide 990 in WO 99/64619;

(b) species homologs of (a);

(c) polynucleotide molecules that encode a polypeptide having mannanase activity that is at least 65% identical to the amino acid sequence of SEQ ID NO: 2 from amino acid residue 31 to amino acid residue 330 in WO 99/64619;

(d) molecules complementary to (a), (b) or (c); and (e) degenerate nucleotide sequences of (a), (b), (c) or (d).

The plasmid pBXM3 comprising the polynucleotide molecule (the DNA sequence) encoding a mannanase of the present invention has been transformed into a strain of the *Escherichia coli* which was deposited by the inventors according to the Budapest Treaty on the International Recognition of the Deposit of Microorganisms for the Purposes of Patent Procedure at the Deutsche Sammlung von Mikroorganismen und Zellkulturen GmbH, Mascheroder Weg 1b, D-38124 Braunschweig, Federal Republic of Germany, on 29 May 1998 under the deposition number DSM 12197.

A fourth more preferred mannanase is described in WO 99/64619. More specifically, this mannanase is:

i) a polypeptide produced by *Bacillus* sp. AAI 12;

ii) a polypeptide comprising an amino acid sequence as shown in positions 32–362 of SEQ ID NO:10 as shown in WO 99/64619; or iii) an analogue of the polypeptide defined in i) or ii) which is at least 65% homologous with said polypeptide, is derived from said polypeptide by substitution, deletion or addition of one or several amino acids, or is immunologically reactive with a polyclonal antibody raised against said polypeptide in purified form.

Also encompassed is the corresponding isolated polynucleotide molecule selected from the group consisting of (a) polynucleotide molecules encoding a polypeptide having mannanase activity and comprising a sequence of nucleotides as shown in SEQ ID NO: 9 from nucleotide 94 to nucleotide 1086 as shown in WO 99/64619;

(b) species homologs of (a);

(c) polynucleotide molecules that encode a polypeptide having mannanase activity that is at least 65% identical to the amino acid sequence of SEQ ID NO: 10 from amino acid residue 32 to amino acid residue 362 as shown in WO 99/64619;

(d) molecules complementary to (a), (b) or (c); and (e) degenerate nucleotide sequences of (a), (b), (c) or (d).

The plasmid pBXM1 comprising the polynucleotide molecule (the DNA sequence) encoding a mannanase of the present invention has been transformed into a strain of the *Escherichia coli* which was deposited by the inventors according to the Budapest Treaty on the International Recognition of the Deposit of Microorganisms for the Purposes of Patent Procedure at the Deutsche Sammlung von Mikroorganismen und Zellkulturen GmbH, Mascheroder Weg 1b, D-38124 Braunschweig, Federal Republic of Germany, on 7 Oct. 1998 under the deposition number DSM 12433.

A fifth more preferred mannanase is described in WO 99/64619. More specifically, this mannanase is:

i) a polypeptide produced by *Bacillus halodurans,* ii) a polypeptide comprising an amino acid sequence as shown in positions 33–331 of SEQ ID NO:12 as shown in WO 99/64619, or iii) an analogue of the polypeptide defined in i) or ii) which is at least 65% homologous with said polypeptide, is derived from said polypeptide by substitution, deletion or addition of one or several amino acids, or is immunologically reactive with a polyclonal antibody raised against said polypeptide in purified form.

Also encompassed is the corresponding isolated polynucleotide molecule selected from the group consisting of:

a) polynucleotide molecules encoding a polypeptide having mannanase activity and comprising a sequence of nucleotides as shown in SEQ ID NO: 11 from nucleotide 97 to nucleotide 993 as shown in WO 99/64619;

(b) species homologs of (a);

(c) polynucleotide molecules that encode a polypeptide having mannanase activity that is at least 65% identical to the amino acid sequence of SEQ ID NO: 12 from amino acid residue 33 to amino acid residue 331 as shown in WO 99/64619;

d) molecules complementary to (a), (b) or (c); and e) degenerate nucleotide sequences of (a), (b), (c) or (d).

The plasmid pBXM5 comprising the polynucleotide molecule (the DNA sequence) encoding a mannanase of the present invention has been transformed into a strain of the *Escherichia coli* which was deposited by the inventors according to the Budapest Treaty on the International Recognition of the Deposit of Microorganisms for the Purposes of Patent Procedure at the Deutsche Sammlung von Mikroorganismen und Zellkulturen GmbH, Mascheroder Weg 1b, D-38124 Braunschweig, Federal Republic of Germany, on 9 Oct. 1998 under the deposition number DSM 12441.

The enzyme-containing compositions herein may optionally also comprise from about 0.001% to about 10%, preferably from about 0.005% to about 8%, most preferably from about 0.01% to about 6%, by weight of an enzyme stabilizing system. The enzyme stabilizing system can be any stabilizing system which is compatible with the detersive enzyme. Such a system may be inherently provided by other formulation actives, or be added separately, e.g., by the formulator or by a manufacturer of detergent-ready enzymes. Such stabilizing systems can, for example, comprise calcium ion, boric acid, propylene glycol, short chain carboxylic acids, boronic acids, and mixtures thereof, and are designed to address different stabilization problems depending on the type and physical form of the detergent composition.

The laundry detergent compositions of the present invention can also include compounds for inhibiting dye transfer from one fabric to another of solubilized and suspended dyes encountered during fabric laundering operations involving colored fabrics. These are generally comprised in the laundry detergent compositions of the present invention at a level of from 0.001% to 10%, preferably from 0.01% to 2%, more preferably from 0.05% to 1% by weight. Polymeric dye transfer inhibiting agents are used to inhibit the transfer of dyes from colored fabrics onto fabrics washed therewith. These polymers have the ability to complex or adsorb the fugitive dyes washed out of dyed fabrics before the dyes have the opportunity to become attached to other articles in the wash. Especially suitable polymeric dye transfer inhibiting agents are polyamine N-oxide polymers, copolymers of N-vinylpyrrolidone and N-vinylimidazole, polyvinylpyrrolidone polymers, polyvinyloxazolidones and polyvinylimidazoles or mixtures thereof.

a) Polyamine N-oxide Polymers

The polyamine N-oxide polymers suitable for use contain units having the following structure formula:

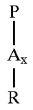

(I)

wherein P is a polymerisable unit, whereto the R—N—O group can be attached to or wherein the R—N—O group forms part of the polymerisable unit or a combination of both.

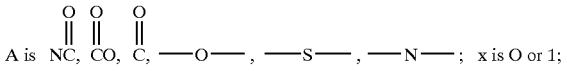

R are aliphatic, ethoxylated aliphatics, aromatic, heterocyclic or alicyclic groups or any combination thereof whereto the nitrogen of the N—O group can be attached or wherein the nitrogen of the N—O group is part of these groups.

The N—O group can be represented by the following general structures:

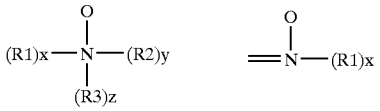

wherein R1, R2, and R3 are aliphatic groups, aromatic, heterocyclic or alicyclic groups or combinations thereof, x or/and y or/and z is 0 or 1 and wherein the nitrogen of the N—O group can be attached or wherein the nitrogen of the N—O group forms part of these groups.

The N—O group can be part of the polymerisable unit (P) or can be attached to the polymeric backbone or a combination of both. Suitable polyamine N-oxides wherein the N—O group forms part of the polymerisable unit comprise polyamine N-oxides wherein R is selected from aliphatic, aromatic, alicyclic or heterocyclic groups. One class of said polyamine N-oxides comprises the group of polyamine N-oxides wherein the nitrogen of the N—O group forms part of the R-group. Preferred polyamine N-oxides are those wherein R is a heterocyclic group such as pyridine, pyrrole, imidazole, pyrrolidine, piperidine, quinoline, acridine and derivatives thereof.

Another class of said polyamine N-oxides comprises the group of polyamine N-oxides wherein the nitrogen of the N—O group is attached to the R-group. Other suitable polyamine N-oxides are the polyamine oxides whereto the N—O group is attached to the polymerisable unit. Preferred class of these polyamine N-oxides are the polyamine N-oxides having the general formula (I) wherein R is an aromatic, heterocyclic or alicyclic groups wherein the nitrogen of the N—O functional group is part of said R group. Examples of these classes are polyamine oxides wherein R is a heterocyclic compound such as pyrridine, pyrrole, imidazole and derivatives thereof. Another preferred class of polyamine N-oxides are the polyamine oxides having the general formula (I) wherein R are aromatic, heterocyclic or alicyclic groups wherein the nitrogen of the N—O functional group is attached to said R groups. Examples of these classes are polyamine oxides wherein R groups can be aromatic such as phenyl.

Any polymer backbone can be used as long as the amine oxide polymer formed is water-soluble and has dye transfer inhibiting properties. Examples of suitable polymeric backbones are polyvinyls, polyalkylenes, polyesters, polyethers, polyamide, polyimides, polyacrylates and mixtures thereof.

The amine N-oxide polymers of the present invention typically have a ratio of amine to the amine N-oxide of 10:1 to 1:1000000. However the amount of amine oxide groups present in the polyamine oxide polymer can be varied by appropriate copolymerization or by appropriate degree of N-oxidation. Preferably, the ratio of amine to amine N-oxide is from 2:3 to 1:1000000. More preferably from 1:4 to 1:1000000, most preferably from 1:7 to 1:1000000. The polymers of the present invention actually encompass random or block copolymers where one monomer type is an amine N-oxide and the other monomer type is either an amine N-oxide or not The amine oxide unit of the polyamine N-xides has a PKa<<10, preferably PKa<7, more preferred PKa<6. The polyamine oxides can be obtained in almost any degree of polymerisation. The degree of polymerisation is not critical provided the material has the desired water-solubility and dye-suspending power.

Typically, the average molecular weight is within the range of 500 to 1000,000; preferably from 1,000 to 50,000, more preferably from 2,000 to 30,000, most preferably from 3,000 to 20,000.

b) Copolymers of N-vinylpyrrolidone and N-vinylimidazole

The N-vinylimidazole N-vinylpyrrolidone polymers used in the present invention have an average molecular weight range from 5,000–1,000,000, preferably from 5,000–200,000.

Highly preferred polymers for use in the laundry detergent compositions according to the present invention comprise a polymer selected from N-vinylimidazole N-vinylpyrrolidone copolymers wherein said polymer has an average molecular weight range from 5,000 to 50,000 more preferably from 8,000 to 30,000, most preferably from 10,000 to 20,000. The average molecular weight range was determined by light scattering as described in Barth H. G. and Mays J. W. Chemical Analysis Vol 113,"Modern Methods of Polymer Characterization". Highly preferred N-vinylimidazole N-vinylpyrrolidone copolymers have an average molecular weight range from 5,000 to 50,000; more preferably from 8,000 to 30,000; most preferably from 10,000 to 20,000.

The N-vinylimidazole N-vinylpyrrolidone copolymers characterized by having said average molecular weight range provide excellent dye transfer inhibiting properties while not adversely affecting the cleaning performance of detergent compositions formulated therewith. The N-vinylimidazole N-vinylpyrrolidone copolymer of the present invention has a molar ratio of N-vinylimidazole to N-vinylpyrrolidone from 1 to 0.2, more preferably from 0.8 to 0.3, most preferably from 0.6 to 0.4 .

c) Polyvinylpyrrolidone

The laundry detergent compositions of the present invention may also utilize polyvinylpyrrolidone ("PVP") having an average molecular weight of from about 2,500 to about 400,000, preferably from about 5,000 to about 200,000, more preferably from about 5,000 to about 50,000, and most preferably from about 5,000 to about 15,000. Suitable polyvinylpyrrolidones are commercially available from ISP Corporation, New York, N.Y. and Montreal, Canada under the product names PVP K-15 (viscosity molecular weight of 10,000), PVP K-30 (average molecular weight of 40,000), PVP K-60 (average molecular weight of 160,000), and PVP K-90 (average molecular weight of 360,000). Other suitable polyvinylpyrrolidones which are commercially available from BASF Cooperation include Sokalan HP 165 and Sokalan HP 12; polyvinylpyrrolidones known to persons skilled in the detergent field (see for example EP-A-262,897 and EP-A-256,696)

d) Polyvinyloxazolidone:

The laundry detergent compositions of the present invention may also utilize polyvinyloxazolidone as a polymeric dye transfer inhibiting agent. Said polyvinyloxazolidones have an average molecular weight of from about 2,500 to about 400,000, preferably from about 5,000 to about 200,000, more preferably from about 5,000 to about 50,000, and most preferably from about 5,000 to about 15,000.

e) Polyvinylimidazole:

The laundry detergent compositions of the present invention may also utilize polyvinylimidazole as polymeric dye transfer inhibiting agent. Said polyvinylimidazoles have an average about 2,500 to about 400,000, preferably from about 5,000 to about 200,000, more preferably from about 5,000 to about 50,000, and most preferably from about 5,000 to about 15,000.

f Cross-linked Polymers:

Cross-linked polymers are polymers whose backbone are interconnected to a certain degree; these links can be of chemical or physical nature, possibly with active groups n the backbone or on branches; cross-linked polymers have been described in the Journal of Polymer Science, volume 22, pages 1035–1039. In one embodiment, the cross-linked polymers are made in such a way that they form a three-dimensional rigid structure, which can entrap dyes in the pores formed by the three-dimensional structure. In another embodiment, the cross-linked polymers entrap the dyes by swelling. Such cross-linked polymers are described in U.S. Pat. No. 5,912,221.

Further, the laundry detergent composition of the present invention can optionally comprise a pearlescing agent to improve the aesthetic appearance of the product. Suitable pearlescing agents are those well known in the art to provide pearlescing effects in surfactant compositions. For instance, pearl lustre mica pigments such Iriodin ex Merck or equivalent e.g. Mearlin Magnapearl from the Meare Corp., or organic compounds having the property to crystallise as pearlescent needles in the product. Typical compounds having this property are polyol esters such as ethylene glycol mon- (EGMS) or di-stearate (EGDS), or polyethyleneglycol mono- (PGMS) or distearate (PGDS). There are several commercial sources for these materials. For instance but not exclusively PEG6000MS ex Stepan, Empilan EGDS/A ex Albright & Wilson, are all suitable pearlescing agents. Other suitable pearlescing agents can be found in WO 99/09944." It is known in the art to further add to pearleacent agent-containing liquid products, a pearlescent crystallization enhancer. Suitable enhancers are the acids, salts, alcohols and esters having a hydrophobic moiety with at least 16C, pref. at least 18C; as described EP 520 551 B. It has been surprisingly found that the semi-polar nonionic surfactants of the present invention and preferably the amine oxide compounds, can function as a crystallization enhancer for organic pearlescent agents. Liquid detergent compositions comprising an organic pearlescent agent and a semi-polar nonionic surfactant, preferably an amine oxide, demonstrate a very attractive pearlescent appearance. It has been further found that liquid laundry detergent compositions comprising the surfactant system of the present invention demonstrate a particularly attractive pearleascent effect.

Detergent Composition Preparation

The laundry detergent compositions according to the present invention can be prepared by combining the essential and optional components in the requisite concentrations in any suitable order and by any conventional means. Granular compositions, for example, are generally made by combining base granule ingredients, e.g., surfactants, builders, water, etc., as a slurry, and spray drying the resulting slurry to a low level of residual moisture (5–12%). The remaining dry ingredients, e.g., granules of the essential cyclic amine based fabric treatment materials, can be admixed in granular powder form with the spray dried granules in a rotary mixing drum. The liquid ingredients, e.g., solutions of the essential cyclic amine based fabric treatment materials, enzymes, binders and perfumes, can be sprayed onto the resulting granules to form the finished detergent composition.

Liquid detergent compositions can be prepared by admixing the essential and optional ingredients thereof in any desired order to provide compositions containing components in the requisite concentrations. Liquid compositions according to the present invention can also be in "compact form", in such case, the liquid detergent compositions according to the present invention will contain a lower amount of water, compared to conventional liquid detergents. Addition of the cyclic amine based polymer, oligomer or copolymer materials to liquid detergent or other aqueous compositions of this invention may be accomplished by simply mixing into the liquid solutions the desired cyclic amine based fabric treatment materials.

Fabric Laundering Method

The present invention also provides a method for laundering fabrics in a manner which imparts fabric cleaning and fabric appearance benefits provided by the combination of the semi-polar nonionic surfactant and the cyclic amine based polymer, oligomer or copolymer materials used herein. Such a method employs contacting these fabrics with an aqueous washing solution formed from an effective amount of the detergent compositions hereinbefore described or formed from the individual components of such compositions. Contacting of fabrics with washing solution will generally occur under conditions of agitation although the compositions of the present invention may also be used to form aqueous unagitated soaking solutions for fabric cleaning and treatment. As discussed above, it is preferred that the washing solution have a pH of less than about 10.0, preferably it has a pH of about 9.5 and most preferably it has a pH of about 7.5. Agitation is preferably provided in a washing machine for good cleaning. Washing is preferably followed by drying the wet fabric in a conventional clothes dryer. An effective amount of a high density liquid or granular detergent composition in the aqueous wash solution in the washing machine is preferably from about 500 to about 7000 ppm, more preferably from about 1000 to about 3000 ppm.

EXAMPLES

The following examples illustrate the compositions and methods of the present invention, but is not necessarily meant to limit or otherwise define the scope of the invention.

Example 1

Synthesis of the Adduct of imidazole and epichlorohydrin (Ratio of imidazole:epichlorohydrin 1:1):

The polycationic condensate is prepared by reacting imidazole and epichlorohydrin. To a round bottomed flask equipped with a magnatic stirrer, condenser and a thermometer are added imidazole (0.68 moles) and 95 mL water. The solution is heated to 50° C. followed by dropwise addition of epichlorohydrin (0.68 moles). After all the epichlorohydrin is added, the temperature is raised to 80° C. until all the alkylating agent is consumed. The condensate produced had molecular weight of about 12,500.

Example 2

Synthesis of the Adduct of imidazole and epichlorohydrin (Ratio of imidazole:epichlorohydrin 1.4:1)

To a round bottomed flask equipped with a magnatic stirrer, condenser and a thermometer are added imidazole (0.68 moles) and 95 mL water. The solution is heated to 50° C. followed by dropwise addition of epichlorohydrin (0.50 moles). After all the epichlorohydrin is added, the temperature is raised to 80° C. until all the alkylating agent is consumed. The condensate produced had molecular weight of about 2000.

Example 3

Synthesis of the Adduct of piperazine, morpholine and epichlorohydrin (Ratio 1.8/0.812.0)

Into a round bottom flask equipped with stirrer, thermometer, dropping funnel and reflux condenser were weighed 154.8 g (1.8 mole) of piperazine and 69.6 g (0.8 mole) of morpholine and 220 ml of water. After a clear solution at 40° C. was obtained, the solution was heated to 55–65° C. and with vigorous stirring 185 g (2 mole) of epichlorohydrin were added at such a rate, that the temperature did not exceed 80° C. After all the epichlorohydrin had been added the reaction mixture was heated to 85° C. until all of the alkylating agents had been consumed (negative Preussmann test after 4 hours). 108.8 g (0.68 mole) of 25% NaOH and 40 g of water were added and the reaction mixture was stirred for another hour at 85° C. Then additional 47 g of water were added and the mixture was allowed to cool to room temperature.

Example 4

Synthesis of the Adduct of piperazine and epichlorohydrin (Ratio of imidazole:epichlorohydrin 1:1)

To a round bottomed flask equipped with a magnatic stirrer, condenser and a thermometer are added piperazine (0.68 moles) and 95 mL water. The solution is heated to 50° C. followed by dropwise addition of epichlorohydrin (0.68 moles). After all the epichlorohydrin is added, the temperature is raised to 80° C. until all the alkylating agent is consumed Example 5

To the condensate in example 4 are added 1.4 mole equivalent of methyl chloride based on piperazine and mixed until all the methyl chloride is consumed.

Example 6

Synthesis of the Adduct of imidazole, piperazine and epichlorohydrin (Ratio of imidazole:piperazine:epichlorohydrin=1:3:4) 68.8 g (1.0 mole) of limidazole and 260.6 g (3.0 mole) of piperazine were solved in 700.2 g of water and at a temperature of 50–60° C. 370 9 (4.0 mole) of epichlorhydrin were added dropwise. After the addition was complete, the reaction mixture was stirred for additional 5 hours at 80° C.

Example 7

(a) Reaction of bis(aminopropyl)piperazine with epichlorohydrin in a Molar Ratio of 2:1

600 g (3 moles) of bis(aminopropyl)piperazine were dissolved in 750 g of water. This solution was heated to 90° C. As soon as this temperature was reached 140.1 g (1.5 moles) of epichlorohydrin were added within 60 minutes at 90° C. The reaction mixture was then stirred at 90° C. for 150 minutes. Thereafter no epichlorohydrin could be detected. The condensation product contained NH groups.

(b) Permethylation of the Condensation Product Obtained Under (a)

99.7 g (content of NH groups was 0.87 moles) of the condensation product obtained according to (a) were mixed with 100.3 g (2.18 moles) of formic acid (99%) with stirring and cooling in an ice bath. 104.5 g (1.045 moles) of formaldehyde in the form of a 30% strength by weight aqueous solution were added in the course of 20 minutes at room temperature. The reaction mixture was then cautiously heated to 60° C. At about 50° C. the evolution of carbon dioxide from the reaction mixture began and became vigorous at 60° C. so that the heating could be removed. After the evolution of carbon dioxide had slowed down the reaction mixture was refluxed for 12 hours. After cooling 100 ml of concentrated hydrochloric acid were added and the water removed from the reaction mixture. 153.6 g of solids were obtained and dissolved in water forming a 50% strength by weight solution of a cyclic amine based polymer substantially free of primary and secondary amino groups. As determined by 13C-NMR spectroscopy, more than 90% of the NH groups were converted into tertiary nitrogen atoms. The amount of quaternary ammonium groups in the polymer was below 5%. The aqueous polymer solution had a pH of 9.58. The k value of the polymer was 8.6.

Example 8

A solution of 92.6 g (1.36 moles) of imidazole in 140.5 g of water was heated to 50° C. and combined in the course of 10 minutes with an aqueous solution of 8.2 g (0.07 moles) of the sodium salt of 2-chloroacetic acid in 50 9 of water. The solution is then heated at 65° C. until all of the sodium salt of 2-chloroacetic acid has reacted as can be analytically determined by the chloride ion content of the solution. 5.6 g (0.07 moles) of a 50% strength by weight aqueous solution of sodium hydroxide were added and 89.7 g (0.97 moles) of epichlorohydrin were added while stirring within 30 minutes so that the temperature of the reaction mixture could be kept in the range of from 55 to 65° C. After the addition of epichlorohydrin the reaction mixture was heated to 80° C. and stirred for 4 hours at this temperature. After this period no more alkylating agent could be detected. 377.7 g of a yellowish aqueous solution of an amphoteric amine based polymer having a net cationic charge of 4.2 mequiv/g polymer were obtained. The solution had a pH of 6.97 and contained 50.3% of water, 0.06% of glycolic acid and less than 0.05% of 2-chloroacetic acid. The molecular weight of the polymer was Mn=700, Mw=1,460 and Mw/Mn=2.1.

Example 9

According to the procedure given in Example 8, 92.6 g (1.36 moles) of imidazole, 16.3 g (0.14 moles) of the sodium salt of 2-chloroacetic acid, 11.2 g (0.14 moles) of a 50% strength by weight aqueous solution of sodium hydroxide and 86.1 g (0.93 moles) of epichlorohydrin were reacted. 386.3 g of a yellowish aqueous solution of an amphoteric amine based polymer having a net cationic charge of 3.4 mequiv/g polymer were obtained. The solution had a pH of 7.10 and contained 49.6% of water, 0.1% glycolic acid and less than 0.05% of 2-chloroacetic acid. The molecular weight of the polymer was Mn=650, Mw=1,320 and Mw/Mn=2.0.

Example 10

According to the procedure given in Example 8, 92.6 g (1.36 moles) of imidazole dissolved in 122.6 g of water, 39.6 g (0.34 moles) of the sodium salt of 2-chloroacetic acid dissolved in 100 g of water, 27.2 g (0.34 moles) of a 50%strength by weight aqueous solution of sodium hydroxide and 76.8 g (0.83 moles) of epichlorohydrin were reacted. 386.3 g of a yellowish aqueous solution of an amphoteric amine based polymer having a net cationic charge of 2.8 mequiv/g were obtained. The solution had a pH of 7.82 and contained 53.4% of water, 0.2% of glycolic acid and less than 0.05% of 2-chloroacetic acid. The molecular weight of the polymer was Mn=540, Mw=1,060 and Mw/Mn=2.0.

Example 11

Example 7 was repeated with the exceptions that 68.1 g (1.0 mole) of imidazole dissolved in 54.9 g of water, 72.0 g (0.6 moles) of the sodium salt of 2-chloroacetic acid dissolved in 150 g of water, 48.0 g (0.6 moles) of a 50% strength by weight solution of sodium hydroxide and 64.8 g (0./moles) of epichlorohydrin were reacted. 446.4 g of a dark yellow aqueous solution of an amphoteric amine based polymer having a net cationic charge of 3.2 mequiv/g were obtained. The solution had a pH of 12.29 and contained 48.2% of water, 0.5% of glycolic acid and less than 0.05% of 2-chloroacetic acid. The molecular weight of the polymer was Mn=740, Mw=1,690 and Mw/Mn=2.3.

Example 12

Example 8 was repeated with the exceptions that 71.5 g (1.05 moles) of imidazole dissolved in 116.3 g of water, 40.8 g (0.34 moles) of the sodium salt of 2-chloroacetic acid dissolved in 100 g of water, 27.2 g (0.24 moles) of a 50% strength by weight solution of sodium hydroxide and 76.8 9 (0.83 moles) of epichlorohydrin were reacted. 427.6 g of a yellow aqueous solution of an amphoteric amine based polymer having a net cationic charge of 3.7 mequiv/g and a K value of 9.5 were obtained. The solution had a pH of 11.62 and contained 54.2% of water, 0.3% of glycolic acid and less than 0.05% of 2-chloroacetic acid. The molecular weight of the polymer was Mn=1,050, Mw=2,380 and Mw/Mn=2.3.

Example 13

68.1 g (1 mole) of imidazole were dissolved in 73.6 g of water and heated to a temperature of 50° C. As soon as this temperature had been reached, a solution of 73.5 g (0.34 moles) of the sodium salt of 3-chloro-2-hydroxypropanesulfonic acid in 150 g of water and 27.2 g (0.34 moles) of a 50% strength by weight aqueous solution of sodium hydroxide were simultaneously added with stirring over a period of 25 minutes. The reaction mixture was then stirred at a temperature of from 65 to 90° C. until all of the sodium salt of 3-chloro-2-hydroxypropanesulfonic acid had reacted as determined analytically by measuring the concentration of chloride ions in the solution. The solution was cooled to 55° C. and 76.8 g (0.83 moles) of epichlorohydrin were introduced within 30 minutes at such a rate that the temperature of the reaction mixture could be kept at 55° C. After completion of the epichlorohydrin addition the reaction mixture was heated to 80° C. and stirred for 4 hours at this temperature. After this period no more alkylating agent could be detected in the reaction mixture. 461.3 g of a clear yellow aqueous solution of an amphoteric amine based polymer having a net cationic charge of 2.9 mequiv/g polymer and a K value of 10.0 were obtained. The solution had a pH of 11.55 and contained 52.4% of water. The molecular weight of the polymer was Mn=1,800, Mw=3,490 and Mw/Mn=1.95.

Example 14

Example 13 was repeated with the exception that 34.1 g (0.5 moles) of imidazole dissolved in 31.3 g of water, 64.8 g (0.35 moles) of the sodium salt of 3-chloro-2-hydroxypropanesulfonic acid dissolved in 100 g of water, 24.0 g (0.3 moles) of a 50% strength by weight aqueous solution of sodium hydroxide and 32.4 g (0.35 moles) of epichlorohydrin were reacted. 284.1 g of a clear yellow aqueous solution of an amphoteric amine based polymer having a net cationic charge of 3.3 mequiv/g polymer and a K value of 7.6 were obtained. The solution had a pH of 11.92 and contained 51.7% of water. The molecular weight of the polymer was Mn=1,100, Mw=1,990 and Mw/Mn=1.80.

Example 15

Synthesis of the Adduct of imidazole/piperazine/epi, in a Ratio 1.0/3.0/4.0 100% oxidized 68.8 g (1.0 mole) of limidazole and 260.6 g (3.0 mole) of piperazine were solved in 700.2 g of water and at a temperature of 50–60° C. 370 g (4.0 mole) of epichlorhydrin were added dropwise. After the addition was complete, the reaction mixture was stirred for additional 5 hours at 80° C. To 237 g of this product (equivalent to 1,022 mole of oxidizable nitrogen atoms) 80.7 g (1.12 mole) of a 47.2% solution of H2O2 in water were added over a period of 5 hours at 40° C. After that the mixture was heated to 50–60° C. until the theoretical amount of H2O2 had been consumed. Unreacted $H_2O_2$ was destroyed by using Pt/C and the solution then filtered.

The reaction product was characterized as follows:

| | |
|---|---|
| water content: | 58.6% |
| pH: | 2.86 |
| chloride content: | 3.694 mmole/g |
| Mn (GPC): | 340 |
| Mw (GPC): | 940 |
| Mn/Mw: | 2.8 +/− 0.1 |

Example 16

The following 2 sets of liquid laundry detergent compositions were prepared in accordance with the present invention:

| | I | II | III | IV |
|---|---|---|---|---|
| $C_{12-18}$ Fatty acid | 8.0 | 8.0 | 8.0 | 8.0 |
| Citric acid | 2.0 | 2.0 | 2.0 | 2.0 |
| $C_{12-14}$ alcohol ethoxylate 7EO | 20.0 | 20.0 | — | 10.0 |
| $C_{12-13}$ alcohol ethoxylate 9EO | — | — | 20.0 | — |
| $C_{13-15}$ alcohol ethoxylate 5EO | — | — | — | 10.0 |
| $C_{12-14}$ dimethylamine oxide | 5.0 | 5.0 | 5.0 | 5.0 |
| Ethanol | 2.0 | 2.0 | — | — |
| Propanediol | 7.0 | 7.0 | 9.0 | 7.0 |
| Monoethanolamine | 5.0 | 5.0 | 5.0 | 5.0 |
| Dispersant polymer | 3.0 | 3.0 | 2.5 | 2.5 |
| Phosphonate | 1.0 | 1.0 | — | 1.0 |
| Chelant | — | — | 1.0 | 1.0 |
| Cyclic amine base polymer | — | compounds and levels as shown in the table below | | |
| Enzyme | 1.0 | 1.0 | 1.5 | 2.0 |
| Ethylene glycol distearate | 0.5 | 1.0 | — | — |
| Borate | 2.0 | 2.0 | 3.0 | 2.0 |
| Miscellaneous and water | | Up to 100% | | |

-continued

| | V | VI | VII | VIII | IX |
|---|---|---|---|---|---|
| $C_{12-18}$ Fatty acid | — | 8.0 | 8.0 | 8.0 | — |
| Citric acid | 7.0 | 2.0 | 2.0 | 2.0 | 6.0 |
| $C_{12-14}$ alcohol ethoxylate 7EO | 22.0 | 20.0 | — | 15.0 | |
| $C_{12-13}$ alcohol ethoxylate 9EO | — | — | 17.0 | — | — |
| $C_{12-13}$ alcohol ethoxylate 5EO | — | — | — | — | 23.0 |
| $C_{12-14}$ dimethylamine oxide | 3.0 | 3.0 | 5.0 | 4.0 | 2.5 |
| $C_{8-10}$ amido propyl dimethylamine | — | 1.5 | — | — | — |
| $C_{12-15}$ alkyl sulfate | — | 2.0 | — | 2.0 | — |
| $C_{12-15}$ alkyl ether 2.5EO sulfate | — | — | 3.0 | — | — |
| $C_{14-15}$ alkyl ether 0.35EO sulfate | — | — | — | 1.0 | — |
| Linear alkyl benzene sulfonate | — | — | — | 2.0 | — |
| Ethanol | 1.0 | — | — | — | 1.0 |
| Propanediol | 7.0 | 9.0 | 9.0 | 9.0 | 12.0 |
| Monoethanolamine | 7.0 | 6.5 | 5.0 | 5.0 | 7.5 |
| Dispersant polymer | 2.5 | 2.0 | 2.5 | 2.5 | 3.0 |
| Phosphonate | 1.0 | 0.5 | — | — | 1.0 |
| Chelant | — | — | 1.0 | 1.0 | — |
| Cyclic amine base polymer | Compounds and levels as shown in the table below | | | | |
| Enzyme | 0.8 | 2.0 | 1.5 | 1.5 | 1.0 |
| Mannanase | — | — | — | — | 0.3 |
| Ethylene glycol distearate | — | 1.0 | — | 1.0 | — |
| Borate | 2.0 | 2.0 | 2.5 | 2.0 | 2.0 |
| Miscellaneous and water | | | Up to 100% | | |

Wherein the components are defined as below:

1) The cyclic amine based polymer is selected from one or more compound(s) illustrated in the table below
2) The chelant is selected from Ethylenediamine-N,N'-disuccinic acid, (S,S) isomer in the form of its sodium salt and/or Diethylene triamine pentaacetic acid.
3) The enzymes are selected from the conventional protease, amylase, lipase and/or cellulase enzymes as described above. Mannanase is the mannanase enzyme sold by Novo Nordisk A/S under the tradename Mannaway.
4) The dispersant polymer is a poly(ethyleneimine) ethoxylated polymer of a molecular weight between 200 and 3000 and an EO between 7 and 30

Example 17

The following granular laundry detergent compositions were prepared in accordance with the present invention:

| | I | II | III |
|---|---|---|---|
| Na $C_{12}$ Linear alkyl benzene sulfonate | 3.0 | 3.0 | 5.0 |
| Na $C_{14-15}$ alkyl sulfonate | 2.0 | 2.0 | — |
| Zeolite Builder | 27.8 | 27.8 | 27.8 |
| Sodium Carbonate | 27.3 | 27.3 | 27.3 |
| PEG 4000 | 1.6 | 1.6 | 1.6 |
| Dispersant, Na polyacrylate | 2.3 | 2.3 | 2.3 |
| $C_{12-13}$ alkyl ethoxylate (E9) | 15.0 | 15.0 | 10.0 |

-continued

| | I | II | III |
|---|---|---|---|
| $C_{12-14}$ dimethylamine oxide | 2.0 | 2.5 | 5.0 |
| Polyvinylpyridine-N-Oxide, with an average molecular weight of 50,000 | 0.5 | — | — |
| Cellulosic polymer | 1.0 | 1.0 | — |
| Sodium Perborate | 1.03 | 1.03 | 1.03 |
| Cyclic amine based polymer/oligomer | level shown in the table below | | |
| Other Adjunct ingredient | Up to 100% | | |

Wherein the cellulosic polymer is a carboxymethylcellulose characterized by

| | |
|---|---|
| Degree of Carboxymethylation | $DS_{RC}$ = 0.3 − 2.0; preferred $DS_{RC}$ = 0.5 − 0.70. |
| Distribution of Carboxymethyls | Even and random distribution of carboxylmethyls along the backbone |
| Molecular Weight | Mw: 5,000–2,000000. Preferred: medium (approx 250,000 g/mol) |
| Type of Modification | Ether modification (in addition to carboxymethylation). Mixed cellulose ether |
| Level of Modification | $DS_{RH}$ = about 0.001 to about 0.1 |

Wherein the cyclic base amine polymer/oligomer are selected from one or more of the compounds below. The chemical structures shown in the examples below are idealized structures. Side reactions expected to occur during the condensation are not shown.

| Material | Level (wt %) |
|---|---|
| Adduct of Imidazole-epichlorohydrin (Ratio of imidazole:epichlorohydrin 1:1, Polymer from Example 1) 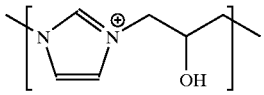 | 3.0 |
| Adduct of Imidazole-epichlorohydrin (Ratio of imidazole:epichlorohydrin 1.36:1, Polymer from Example 2) 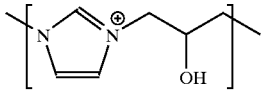 | 0.8 |
| Adduct of Imidazole-epichlorohydrin (Ratio of imidazole:epichlorohydrin 1.75:1) 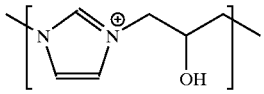 | 0.8 |
| Adduct of Imidazole-epichlorohydrin-trisglycidyl ether from glycerine (Ratio of imidazole:epichlorohydrin:trisglycidylether 2.0:1.76:0.26) 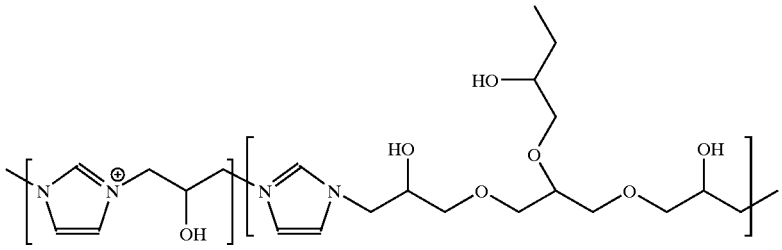 | 0.8 |
| Adduct of Imidazole-epichlorohydrin-trisglycidyl ether from glycerine (Ratio of imidazole:epichlorohydrin:trisglycidyl ether from glycerine 2.0:1.9:0.1) 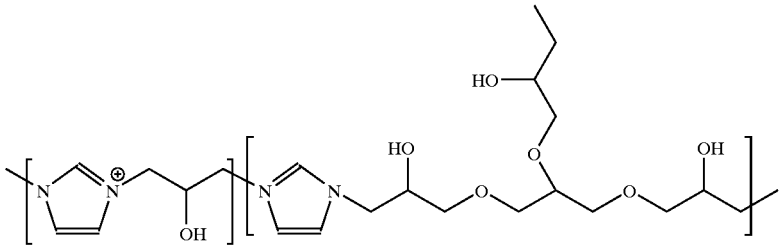 | 0.8 |

-continued

| Material | Level (wt %) |
|---|---|
| Adduct of piperazine and epichlorohydrin (ratio 1:1) 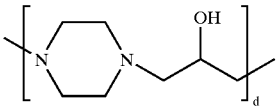 | 0.8 |
| Adduct of piperazine and epichlorohydrin (ratio 1:1) benzyl quat 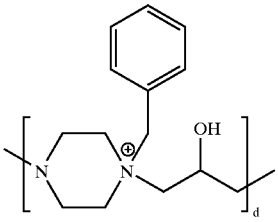 | 0.8 |
| Adduct of piperazine and epichlorohydrin (ratio 1:1) methyl quat 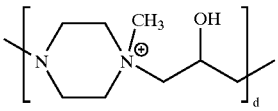 | 0.8 |
| Adduct of piperazine, morpholine and epichlorohydrin (ratio 0.9:0.4:1.0) 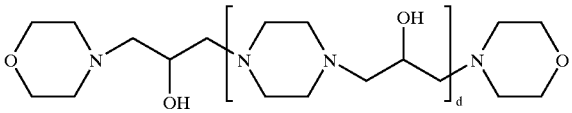 | |
| Adduct of piperazine, piperidine and epichlorohydrin (ratio 0.9:0.4:1.0) 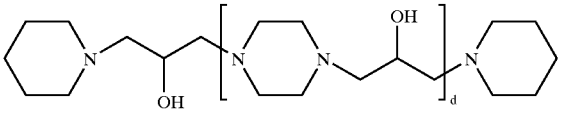 | 0.8 |
| Adduct of piperazine, morpholine and epichlorohydrin (ratio 0.9:0.4:1.0) methyl quat 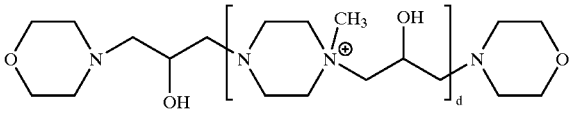 | 0.8 |
| Adduct of piperazine, piperidine and epichlorohydrin (ratio 0.9:0.4:1.0) methyl quat 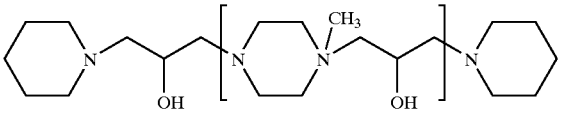 | 0.8 |
| Adduct of piperazine, morpholine and epichlorohydrin (ratio 0.9:0.4:1.0) benzyl quat 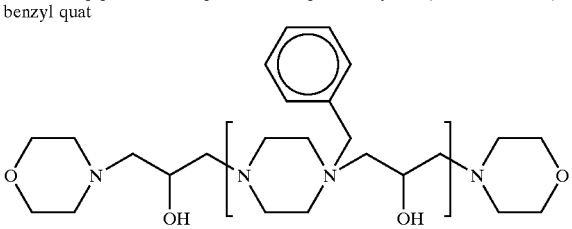 | 0.8 |

-continued

| Material | Level (wt %) |
|---|---|
| Adduct of piperazine, piperidine and epichlorohydrin (ratio 0.9:0.4:1.0) benzyl quat 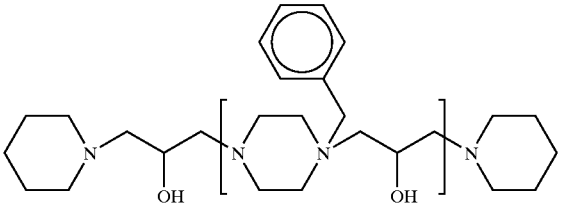 | 0.8 |
| Adduct of imidazole, piperazine and epichlorohydrin (ratio 2:1:3) 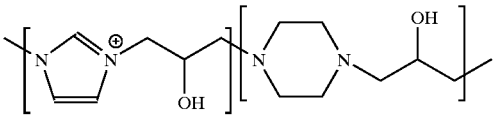 | 0.8 |
| Adduct of imidazole, piperazine and epichlorohydrin (ratio 1:1:2) 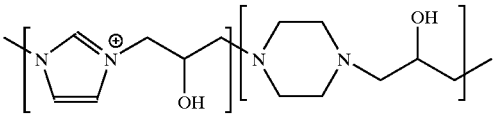 | 0.8 |
| Adduct of imidazole, 1,6 diaminohexane and epichlorohydrin (ratio 1:1:2) 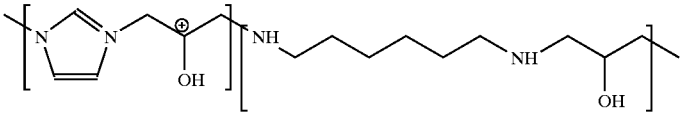 | 0.8 |
| Adduct of imidazole, dimethylaminopropylamine and epichlorohydrin (ratio 1.02:0.34:1.0) 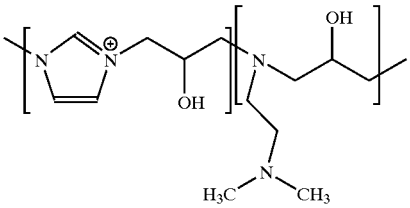 | 0.8 |
| Adduct of imidazole-epichlorohydrin and chloroacetic acid (Ratio-1.36:0.83:0.34) 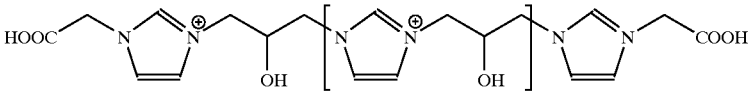 | 1.0 |
| Adduct of imidazole, piperazine and epichlorohydrin (Ratio-1.0:1.0:2.0) quat with 0.22 moles of chloroacetate 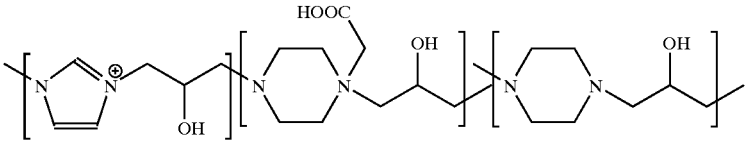 | 0.5 |
| Adduct of imidazole, piperazine and epichlorohydrin (Ratio-1.0:3.0:4.0) quat with 0.32 moles of chloroacetate 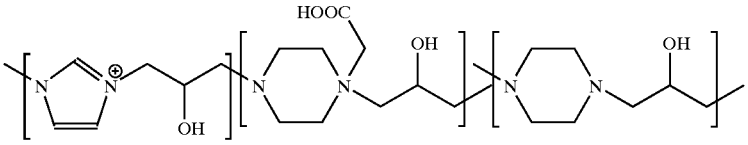 | 2.0 |

-continued

| Material | Level (wt %) |
|---|---|
| Adduct of imidazole and epichlorohdrin, (ratio 1.75:1) oxidized 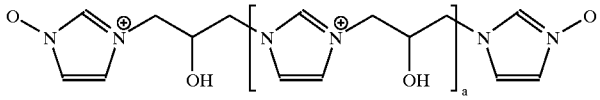 | 0.1 |

What is claimed is:

1. A laundry detergent composition comprising no more than 5%, by weight, anionic surfactant, from 15% to 50%, by weight, of nonionic surfactant and from 0.1% to 20%, by weight, of a semi-polar nonionic surfactant selected from the group consisting of the amine oxides, phosphine oxides and sulfoxides, an organic pearlescent agent selected from the group consisting of ethylene glycol distearate, ethylene glycol monostearate, and mixtures thereof, and a cyclic amine based polymer, oligomer or copolymer of the general formula:

$$T-[W-R_2]_x-W-T \quad A_b$$

wherein;

each T is independently selected from the group consisting of H, $C_1$–$C_{12}$ alkyl, substituted alkyl, $C_7$–$C_{12}$ alkylaryl, —$(CH_2)_hCOOM$, —$(CH_2)_hSO_3M$, $CH_2CH(OH)SO_3M$, —$(CH_2)_hOSO_3M$,

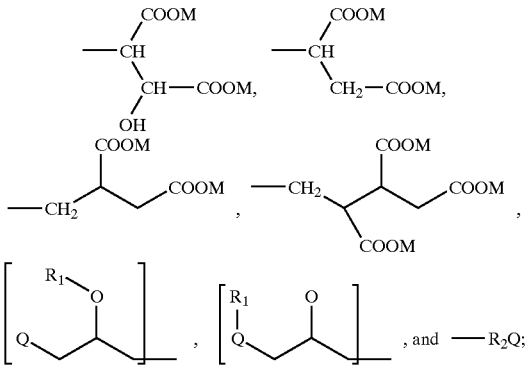

wherein W comprises at least one cyclic constituent selected from the group consisting of:

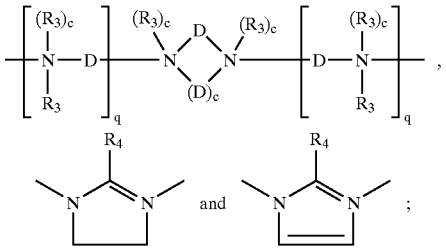

wherein in addition to the at least one cyclic constituent, W may also comprise an aliphatic or substituted aliphatic moiety of the general structure;

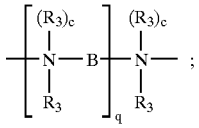

each B is independently $C_1$–$C_{12}$ alkylene, $C_1$–$C_{12}$ substituted alkylene, $C_3$–$C_{12}$ alkenylene, $C_8$–$C_{12}$ dialkylarylene, $C_8$–$C_{12}$ dialkylarylenediyl, and —$(R_5O)_nR_5$—;

each D is independently $C_2$–$C_6$ alkylene;

each Q is independently selected from the group consisting of hydroxy, $C_1$–$C_{18}$ alkoxy, $C_2$–$C_{18}$ hydroxyalkoxy, amino, $C_1$–$C_{18}$ alkylamino, dialkylamino, trialkylamino groups, heterocyclic monoamino groups and diamino groups;

each $R_1$ is independently selected from the group consisting of H, $C_1$–$C_{18}$ alkyl and $C_1$–$C_{18}$ hydroxyalkyl;

each $R_2$ is independently selected from the group consisting of $C_1$–$C_{12}$ alkylene, $C_1$–$C_{12}$ alkenylene, —$CH_2$—$CH(OR_1)$—$CH_2$, $C_8$–$C_{12}$ alkarylene, $C_4$–$C_{12}$ dihydroxyalkylene, poly($C_2$–$C_4$ alkyleneoxy)alkylene, $H_2CH(OH)CH_2OR_2OCH_2CH(OH)CH_2$—, and $C_3$–$C_{12}$ hydrocarbyl moieties;

provided that when $R_2$ is a $C_3$–$C_{12}$ hydrocarbyl moiety the hydrocarbyl moiety can comprise from about 2 to about 4 branching moieties of the general structure:

$$-(OR_5)_r-[O-CH_2-CH(OH)-CH_2]_t-[W-R_2]_x-W-T,$$

each $R_3$ is independently selected from the group consisting of H, $R_2$, O, $C_1$–$C_{20}$ hydroxyalkyl, $C_1$–$C_{20}$ alkyl, substituted alkyl, $C_6$–$C_{11}$ aryl, substituted aryl, $C_7$–$C_{11}$ alkylaryl, $C_1$–$C_{20}$ aminoalkyl, —$(CH_2)_hCOOM$, —$(CH_2)_hSO_3M$, $CH_2CH(OH)SO_3M$,

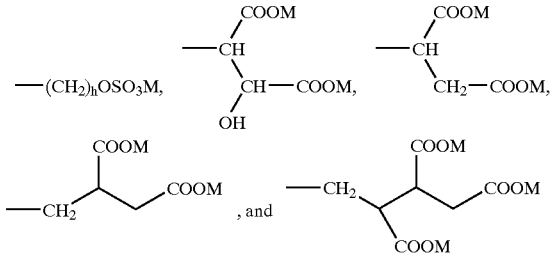

each $R_4$ is independently selected from the group consisting of H, $C_1$–$C_{22}$ alkyl, $C_1$–$C_{22}$ hydroxyalkyl, aryl and $C_7$–$C_{22}$ alkylaryl;

each $R_5$ is independently selected from the group consisting of $C_2$–$C_8$ alkylene, $C_2$–$C_8$ alkyl substituted alkylene; and A is a compatible monovalent or di or polyvalent anion;

M is a compatible cation;

b=number necessary to balance the charge;

each x is independently from 3 to about 1000;

each c is independently 0 or 1;

each h is independently from about 1 to about 8;

each q is independently from about 0 to about 6;

each n is independently from about 1 to about 20;

each r is independently from about 0 to about 20; and each t is independently from about 0 to about 1.

2. A laundry detergent composition according to claim 1, wherein said cyclic amine based polymer, oligomer or copolymer is an adduct of two more compounds selected from the group consisting of piperazine, piperadine, epichlorohydrin, epichlorohydrin benzyl quat, epichlorohydrin methyl quat, morpholine and mixtures thereof.

3. A laundry detergent composition according to claim 1, wherein each $R_1$ is H and at least one W is selected from the group consisting of:

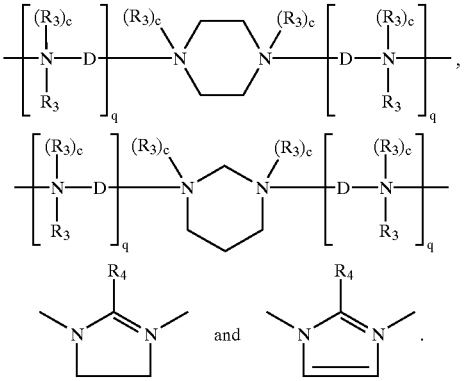

4. A laundry detergent composition according to claim 1, wherein each $R_1$ is H and at least one W is selected from the group consisting of:

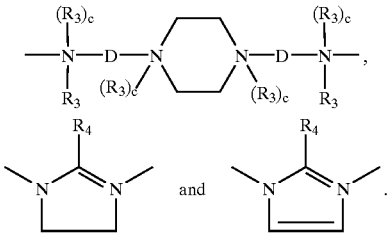

5. A laundry detergent composition according to claim 1, wherein each $R_1$ is H and at least one W is selected from the group consisting of:

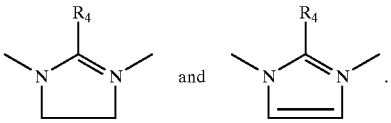

6. The laundry detergent composition according to claim 1, wherein x is from 3 to 25.

7. A laundry detergent composition according to claim 1 wherein said cyclic amine based polymer, oligomer or copolymer is comprises at a level of 0.01% to 5% by the weight of the total composition.

8. A laundry detergent composition according to claim 1 wherein said semi-polar nonionic surfactant is an amine oxide surfactant.

9. A laundry detergent composition according to claim 1 which is free of anionic surfactant.

10. A laundry detergent composition according to claim 1 further comprising an ingredient selected from a group consisting of a cellulosic based polymer or oligomer, a cationic surfactant, a dye transfer inhibiting polymer, a mannanase enzyme, and mixtures thereof.

11. A method of using a laundry detergent composition according to claim 2 comprising contacting soiled laundry with said composition to provide cleaning and fabric care properties.

12. A method of using a laundry detergent composition according to claim 1 comprising contacting soiled laundry with said composition to provide fabric color maintenance.

* * * * *